US012714251B2

(12) United States Patent
Bing et al.

(10) Patent No.: US 12,714,251 B2
(45) Date of Patent: Aug. 25, 2026

(54) SEPARABLE HOSPITAL CURTAIN

(71) Applicant: Cintas Corporate Services, Inc., Cincinnati, OH (US)

(72) Inventors: Richard R. Bing, West Chester, OH (US); Bryan J. Colpo, Cincinnati, OH (US); Shawn K. King, Mason, OH (US); David Steven Mesko, Wyoming, OH (US); Amy E. Wilker, Bellevue, KY (US); Michael Komatz, Ny, NY (US); Adem Önalan, Istanbul (TR); Marco Perry, Brooklyn, NY (US); Brooke Williams, New York, NY (US)

(73) Assignee: Cintas Corporate Services, Inc., Cincinnati, OH (US)

( * ) Notice: Subject to any disclaimer, the term of this patent is extended or adjusted under 35 U.S.C. 154(b) by 240 days.

(21) Appl. No.: 17/988,919

(22) Filed: Nov. 17, 2022

(65) Prior Publication Data

US 2023/0148779 A1 May 18, 2023

Related U.S. Application Data

(60) Provisional application No. 63/320,366, filed on Mar. 16, 2022, provisional application No. 63/320,369,
(Continued)

(51) Int. Cl.
*A47H 23/04* (2006.01)
*A47H 1/04* (2006.01)
(Continued)

(52) U.S. Cl.
CPC ..... *A47H 23/04* (2013.01); *A47H 1/04* (2013.01); *A47H 13/00* (2013.01); *A47H 23/02* (2013.01);
(Continued)

(58) Field of Classification Search
CPC ..... A47G 5/00; A47K 3/38; A47H 2201/00; A47H 2001/045; A47H 1/04; A47H 13/00;
(Continued)

(56) References Cited

U.S. PATENT DOCUMENTS 588,454 A 8/1897 Lloyd
708,381 A 9/1902 Miller
(Continued)

*Primary Examiner* — Daniel P Cahn
*Assistant Examiner* — Matthew R. Shepherd
(74) *Attorney, Agent, or Firm* — FBT Gibbons LLP

(57) ABSTRACT

A curtain is suitable for use in hospital, patient facilities or surgical settings. The curtain includes a bottom panel removably attached and suspended from a top panel. The top panel may be suspended from a rail or similar mechanism by suspension means such as hooks or rings. The top panel may comprise a mesh or mesh-like fabric or substance so as to allow air, light, and/or water to pass through. The bottom panel may be opaque to provide privacy, and may be flame resistant and/or antibacterial. The bottom panel may be single-use or disposable, or may be reusable. The top and bottom panels are joined by a zipper to allow for removal of the bottom panel for washing or replacement. The zipper track has curved portions to allow for easier access to begin the zipping and unzipping process.

3 Claims, 32 Drawing Sheets

Related U.S. Application Data filed on Mar. 16, 2022, provisional application No. 63/317,112, filed on Mar. 7, 2022, provisional application No. 63/304,833, filed on Jan. 31, 2022, provisional application No. 63/280,651, filed on Nov. 18, 2021.

(51) Int. Cl.
*A47H 13/00* (2006.01)
*A47H 23/02* (2006.01)

(52) U.S. Cl.
CPC .... *A47H 2001/045* (2013.01); *A47H 2201/00* (2013.01)

(58) Field of Classification Search
CPC ... A47H 23/04; A47H 23/02; A47H 2023/025
USPC ..... 160/DIG. 18
See application file for complete search history.

(56) References Cited

U.S. PATENT DOCUMENTS 1,413,846 A 4/1922 Fredak
1,447,149 A 2/1923 Pfeiffer
1,809,109 A 6/1931 Clark et al.
2,273,426 A 2/1942 Washburn
2,375,457 A 5/1945 Woodward
2,654,486 A 10/1953 Lundkvist
3,120,895 A 2/1964 Mahana et al.
3,416,672 A 12/1968 Kohaut
3,777,314 A 12/1973 Boser
3,968,523 A 7/1976 Newman
4,606,527 A 8/1986 Ziller et al.
4,693,291 A * 9/1987 Andrews ..... A47H 13/04 160/332
4,996,933 A 3/1991 Boser
5,217,057 A 6/1993 Hubbard et al.
5,240,758 A 8/1993 Honigberg
5,410,975 A 5/1995 Dudek et al.
6,192,965 B1 * 2/2001 Hinds ..... A47K 3/38 160/DIG. 18
6,394,168 B1 * 5/2002 Zoboski ..... A47H 13/00 160/DIG. 18
7,350,244 B1 4/2008 Handley
7,909,082 B2 3/2011 Peoples
8,464,365 B1 * 6/2013 Nunn ..... A41D 1/08 2/227
8,500,188 B2 * 8/2013 Huotari ..... B60J 7/10 296/146.14
9,204,749 B1 * 12/2015 Trapani ..... A61G 12/00
9,661,947 B2 5/2017 Mayer
10,973,356 B2 4/2021 Choi
10,975,605 B2 4/2021 Hamilton et al.
11,944,227 B1 4/2024 Green et al.
2006/0026747 A1 * 2/2006 Prabhakar ..... A47K 3/38 4/558
2007/0261803 A1 * 11/2007 Alexander ..... A47H 21/00 160/341
2007/0284058 A1 * 12/2007 Peoples ..... A47H 2/00 160/123
2012/0222826 A1 9/2012 Foss et al.
2013/0205548 A1 * 8/2013 Wehner ..... D05B 35/064 112/475.16
2014/0209255 A1 7/2014 Degiovanni et al.
2019/0000240 A1 * 1/2019 Rabbany ..... A47C 31/007
2022/0007872 A1 * 1/2022 Stern ..... A47H 23/08
2023/0148778 A1 5/2023 Bing et al.
2023/0329470 A1 10/2023 Bing et al.
2023/0404298 A1 12/2023 Blase

* cited by examiner

SEPARABLE HOSPITAL CURTAIN

BACKGROUND

This claims the benefit of U.S. Provisional Patent Applications Ser. No. 63/280,651, filed Nov. 18, 2021; Ser. No. 63/304,833, filed Jan. 31, 2022; Ser. No. 63/317,112, filed Mar. 7, 2022; Ser. No. 63/320,369, filed Mar. 16, 2022; and Ser. No. 63/320,366, filed Mar. 16, 2022, each of which is hereby incorporated by reference in its entirety.

This invention relates generally to curtains and, more specifically, the invention relates to a detachable, ventilating enclosure for use with a supporting structure or railing to provide an enclosure of the type utilized for hospital settings, surgical facilities, or the like.

Curtains are often used to divide larger hospital rooms into individual patient or examination areas. They are useful in providing a patient with his or her own private area when other patients are in the room or to provide privacy in higher traffic settings in a hospital, clinic or other healthcare facility, such as an emergency room or post-operative recovery room. Often, the curtains are attached by hooks or other means that are slidably mounted to curtain tracks attached to the ceiling of the hospital room or other healthcare facility. The slidable mounting makes it convenient for the curtains to be moved back and forth between open and closed positions so that a health care professional, visitor, or the patient may enter and exit the area with ease.

Typically, hospital curtains are made from cloth or a cloth-like material. Due to the fibrous nature of this type of material, the cubicle curtains often become a haven for bacteria and microbial growth. Bacteria and germs are transmitted to and from the curtains through the air or by physical contact. Moreover, the process of installing a new or washed and cleaned curtain may result in the curtain contacting the floor and attracting contaminants and unwanted particles that might be present on the floor.

Such curtains in the prior art are expensive to manufacture, difficult to launder, and may increase the risk of infection. One noted problem is that removal of prior curtains for cleaning often requires the individual removing the curtain to stand on a chair or similar piece of furniture to reach the top of the curtain and detach the curtain from the ceiling mounted rail or support mechanism. Replacement of a curtain has a similar problem. This can be dangerous to the individual doing the removing and any patient nearby. Use of a chair or ladder may be required to adequately access and remove/install the curtain. This can be potentially dangerous if the person falls from the chair or ladder and, at the least, is time consuming and cumbersome, especially if dozens of curtains are being removed and reinstalled at a time.

It is known in the art to make a bottom portion of the curtain separable from the top portion as shown in U.S. Pat. No. 9,204,749, which is hereby incorporated by reference in its entirety. In the invention disclosed in the '749 patent, the hospital curtain is made up of a ventilated top portion attached by curtain carriers and eyelets to a ceiling mounted curtain track, and a bottom portion joined to a bottom edge of the top portion by a zipper for selective removal of the bottom portion for washing or replacement. However, the zipper is often located at a height well above the floor of the room and is difficult for most service personnel to easily unzip or zip the bottom portion from/to the top portion without the benefit of a ladder, step stool or other device. One of the drawbacks to this type of design is that most zippers are designed for attaching two portions of material along a substantially straight section of each portion of the material.

Accordingly, what is needed is an improved hospital curtain that can be easily and safely removed and replaced without the need for a ladder or other assisting device to remove and replace the curtain.

The above and other objects and advantages in accordance with the principles of this invention shall be made apparent from the accompanying drawings and the description thereof.

SUMMARY OF THE INVENTION

This invention overcomes these and other shortcomings of the prior art by providing a hospital curtain having of a ventilated narrow top portion slideably attached along a ceiling track. A wide bottom portion of the curtain is removably attached to the narrow top portion by a zipper extending therebetween.

One feature of the hospital curtain according to various embodiments of this invention is a zipper or other attachment mechanism which joins the lower edge of the top panel to the upper edge of the bottom panel. Zippers are well known in the art for such an attachment mechanism, but the zipper according to various embodiments of this invention may have a contoured shape or curved portions to join the bottom edge of the top portion to the top edge of the bottom portion. The curved portions allow for the ends of the zipper tracks to extend downwardly for easier access to a user zipping the curtain portions together or unzipping them apart. The contour of the zipper includes relatively small radius curved portions to make it easier for an installer who may not be able to reach the lower edge of the top panel for installation and/or removal of the bottom panel. The lateral ends of the zipper extend downwardly from the lower edge of the top panel for more convenient access when mating the zipper portions on the top and bottom panels together or unzipping them apart.

An additional aspect of various embodiments of this invention is a zipper assist pole with a head feature designed to engage a zipper pull on the zipper and allow a user to pull the zipper pull across the joint between the top and bottom portions to zip them together or unzip them apart. The zipper assist pole allows a user to comfortably stand on the floor grasping the pole and engage the zipper pull with the zipper assist pole head to pull the zipper pull along the zipper track above head level.

The top panel may be solid, or include a mesh or mesh-like fabric or substance. The top panel may be constructed so as to allow air or light to pass through. The bottom panel may be opaque so as to provide privacy, and may be manufactured from a variety of materials known to the industry, including but not limited to polypropylene, polyester, treated natural fibers, or other fabrics. The material may be flame resistant and/or antibacterial. The bottom panel may be single-use or disposable, or may be reusable. In one exemplary embodiment, the bottom panel is manufactured from sturdy material able to withstand frequent washings or cleanings. Once removed from the top panel, the bottom panel may be discarded or laundered and reinstalled on the same or a different top panel. Once the bottom panel is removed from the top panel, a different and clean bottom panel may be installed onto the top panel.

Easy removal and replacement of the bottom panel for cleaning and other purposes is thereby promoted by embodiments of this invention. Once removed, the bottom panel may be cleaned and re-installed onto the top panel. Alternatively, a different, new and/or clean bottom panel may be installed on the top panel which may be part of a service providers role in the maintenance of the clinical setting and associated curtain installation.

Further areas of applicability of this invention will become apparent from the detailed description provided hereinafter. It should be understood that the detailed description and specific examples, while indicating embodiments of the invention, are intended for purposes of illustration only and are not intended to limit the scope of the invention.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

CCN-107 Follows

CCN-107A Follows

Figure 7:
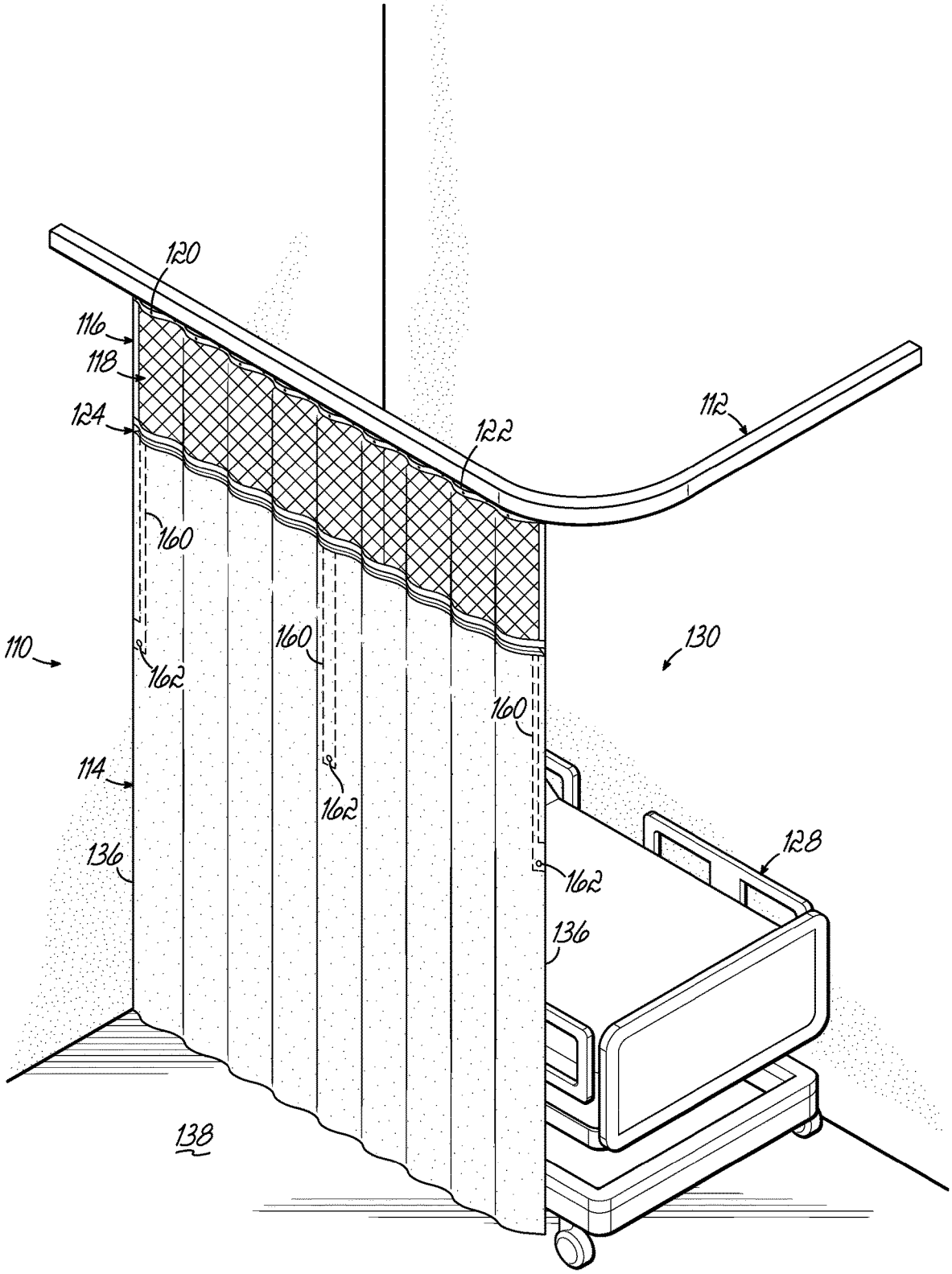
Figure 8:
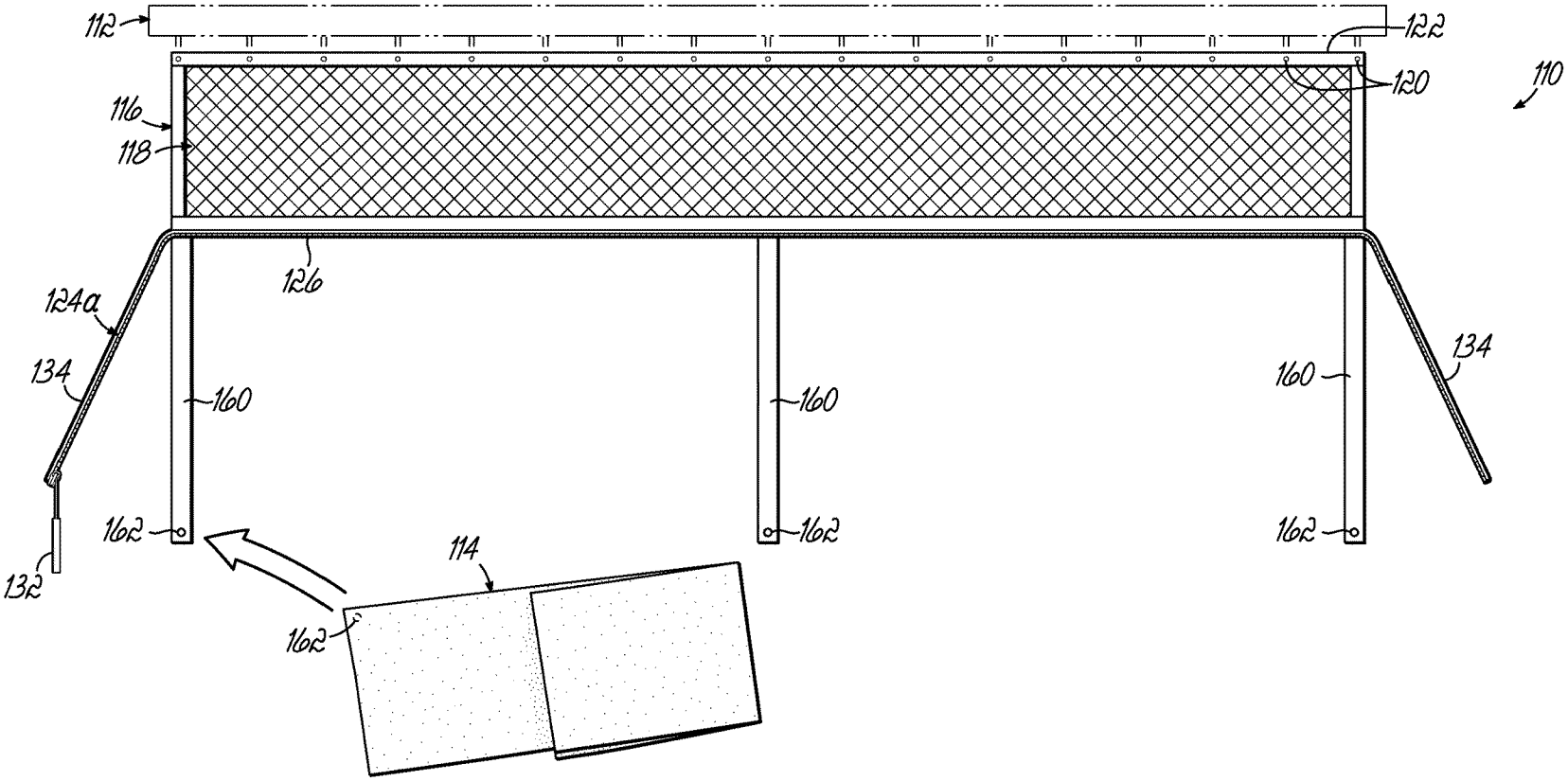
Figure 9:
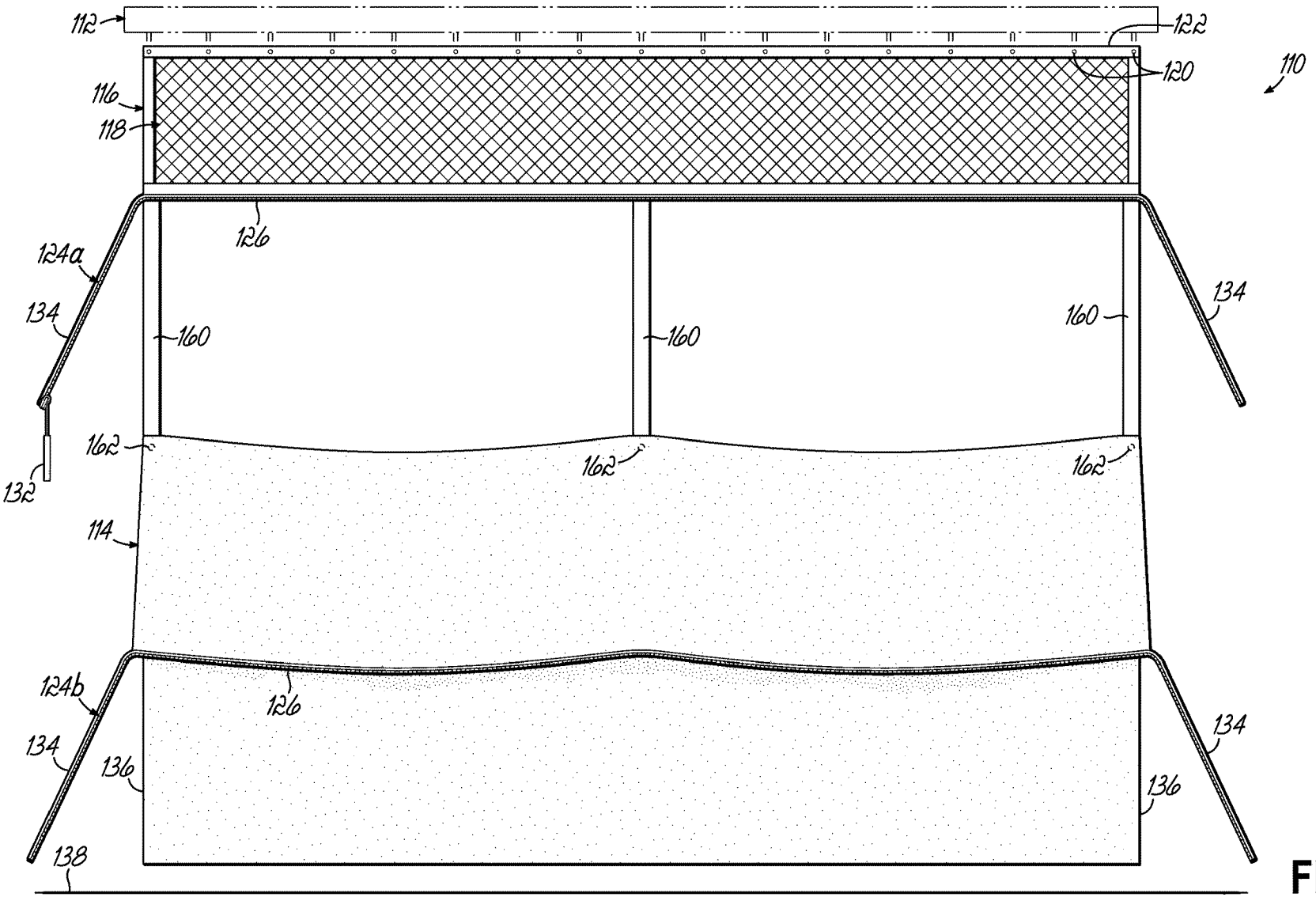
Figure 10:
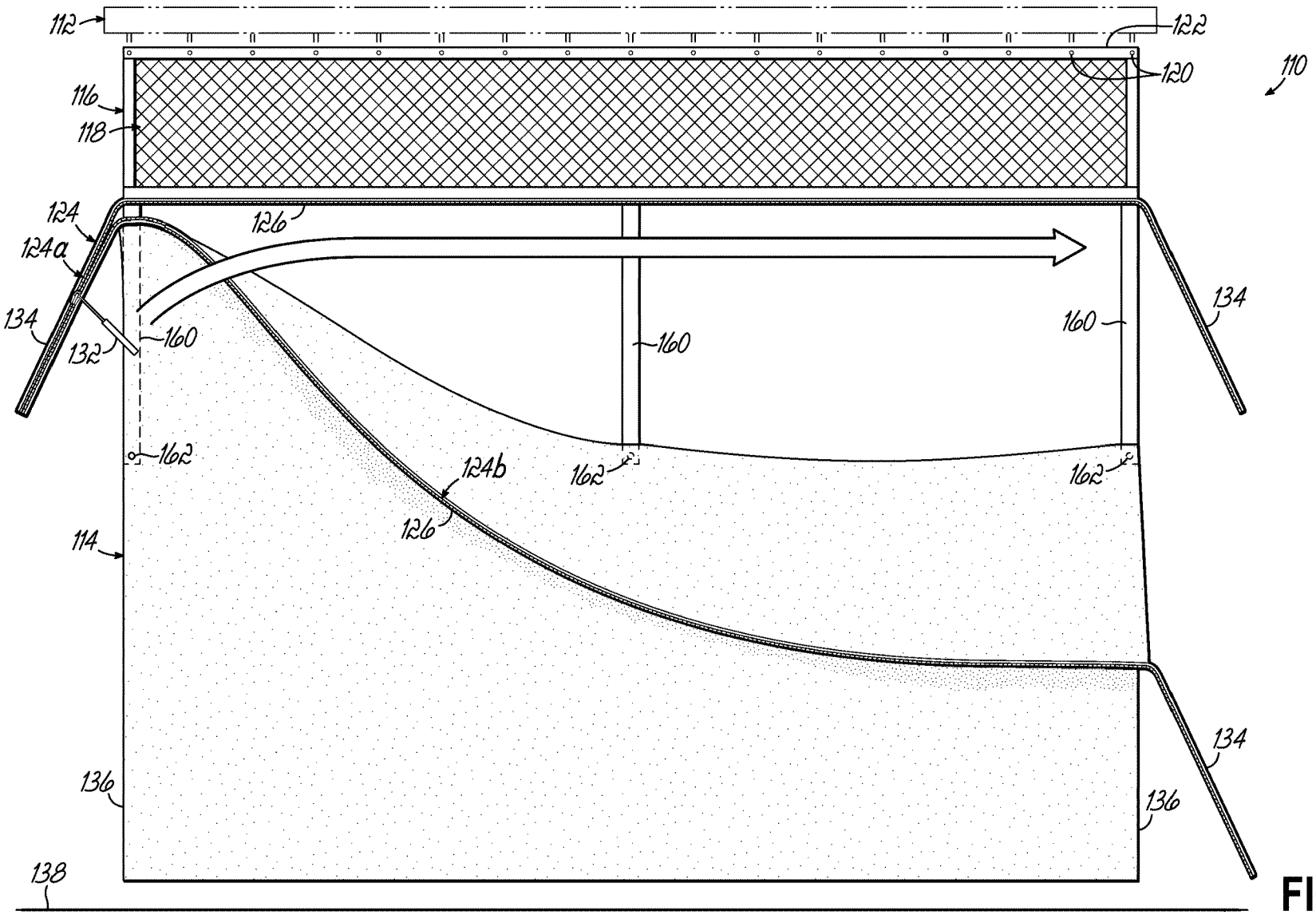
Figure 11:
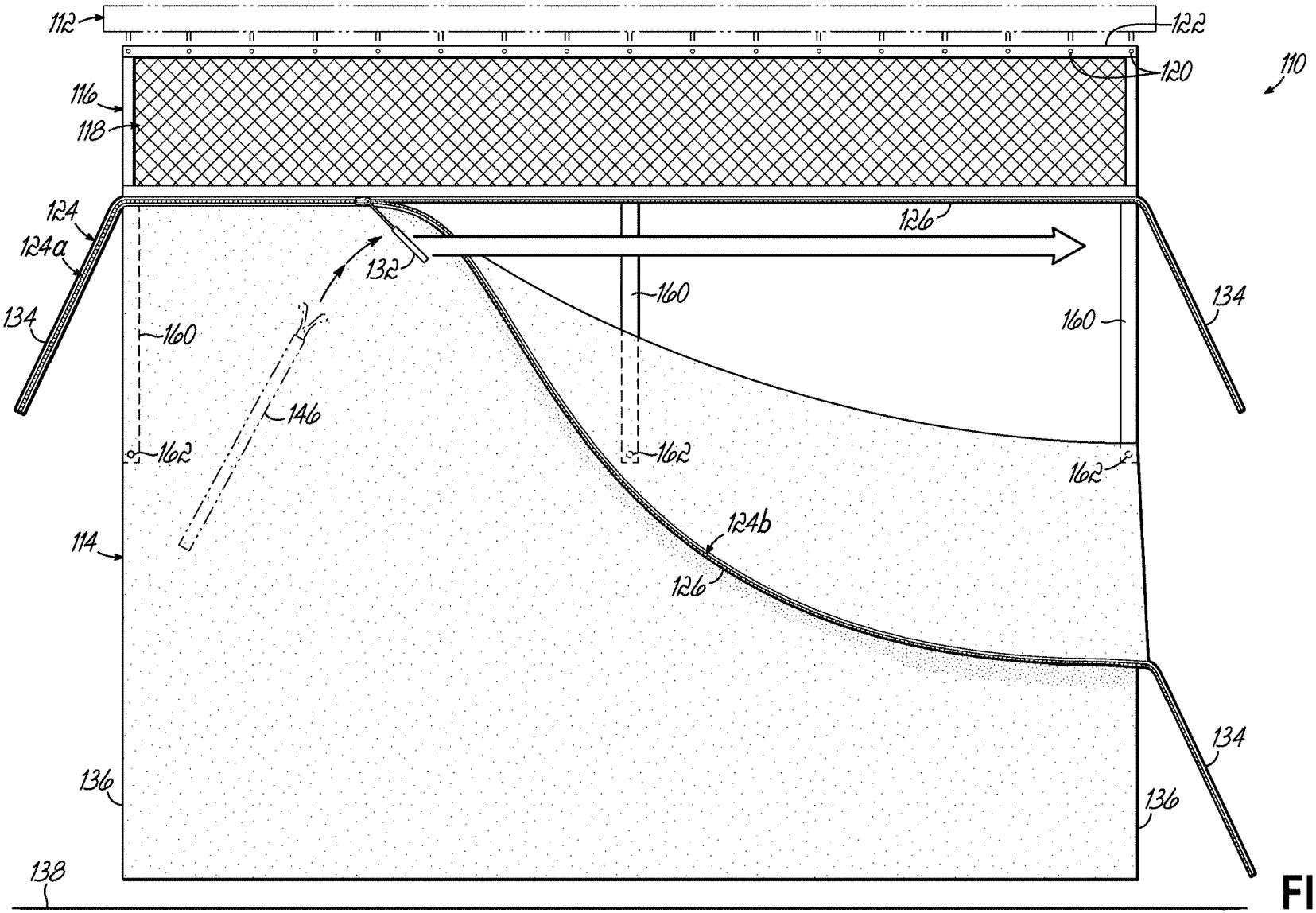
Figure 11A:
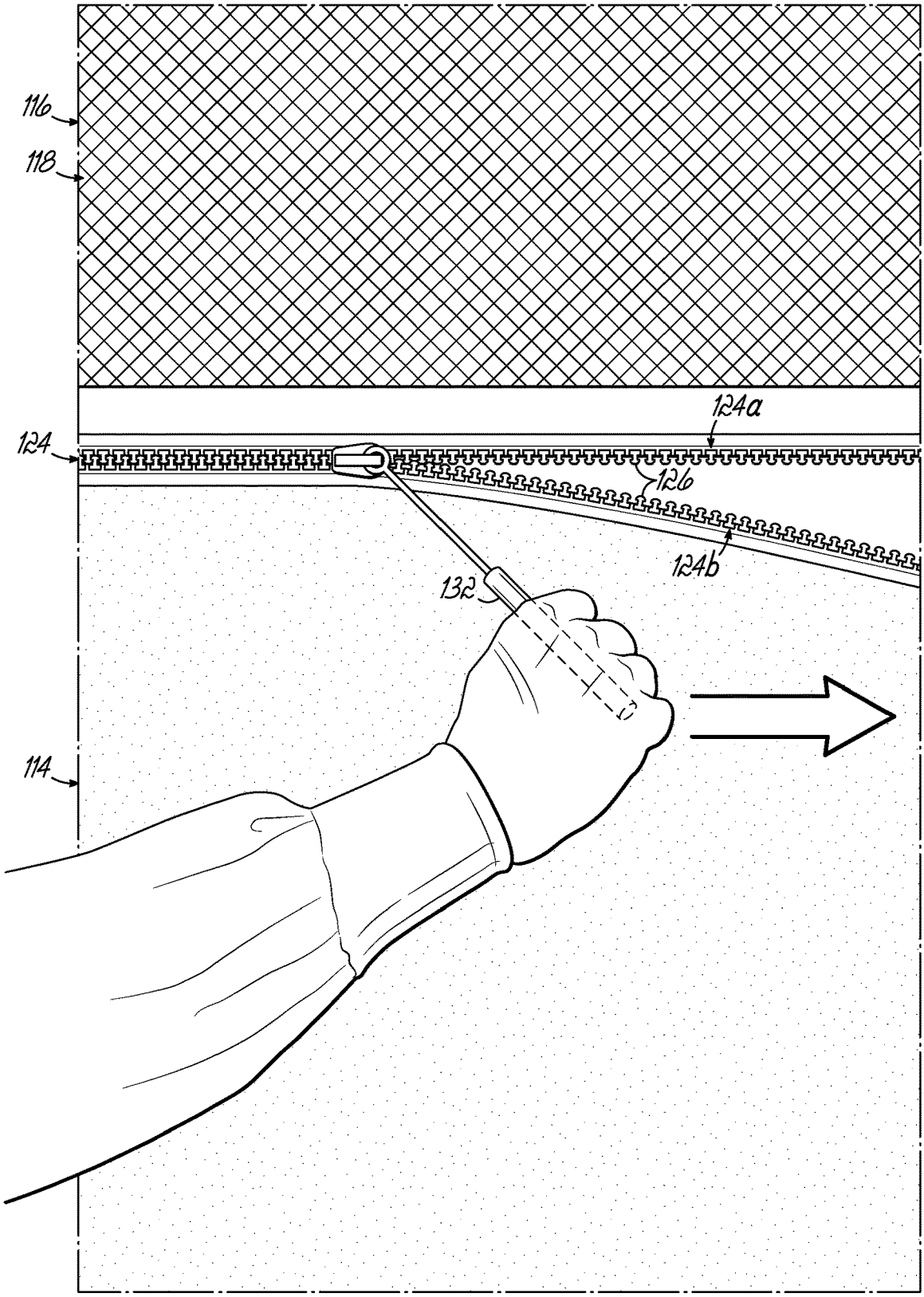
Figure 11B:
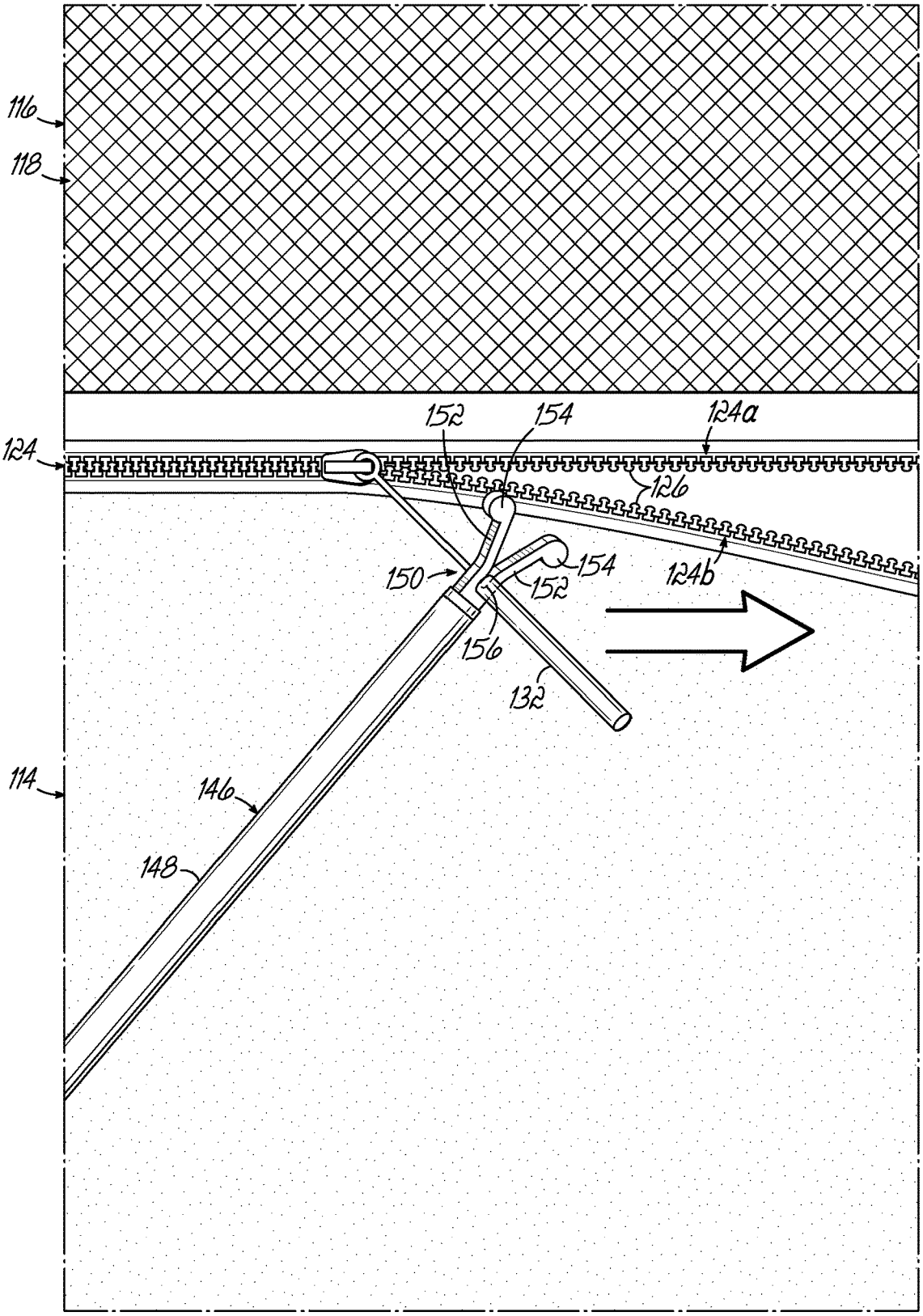
Figure 12:
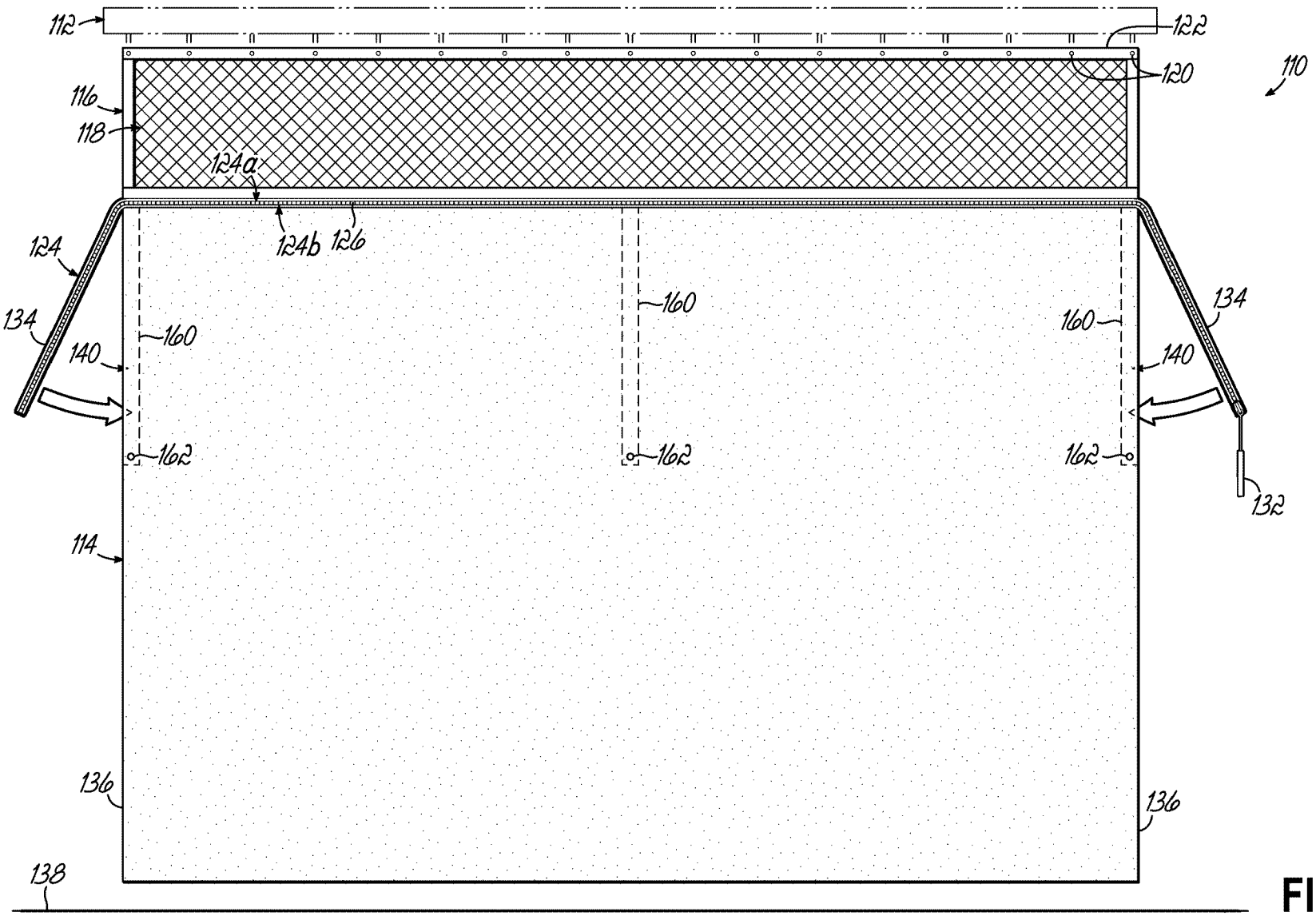
Figure 12A:
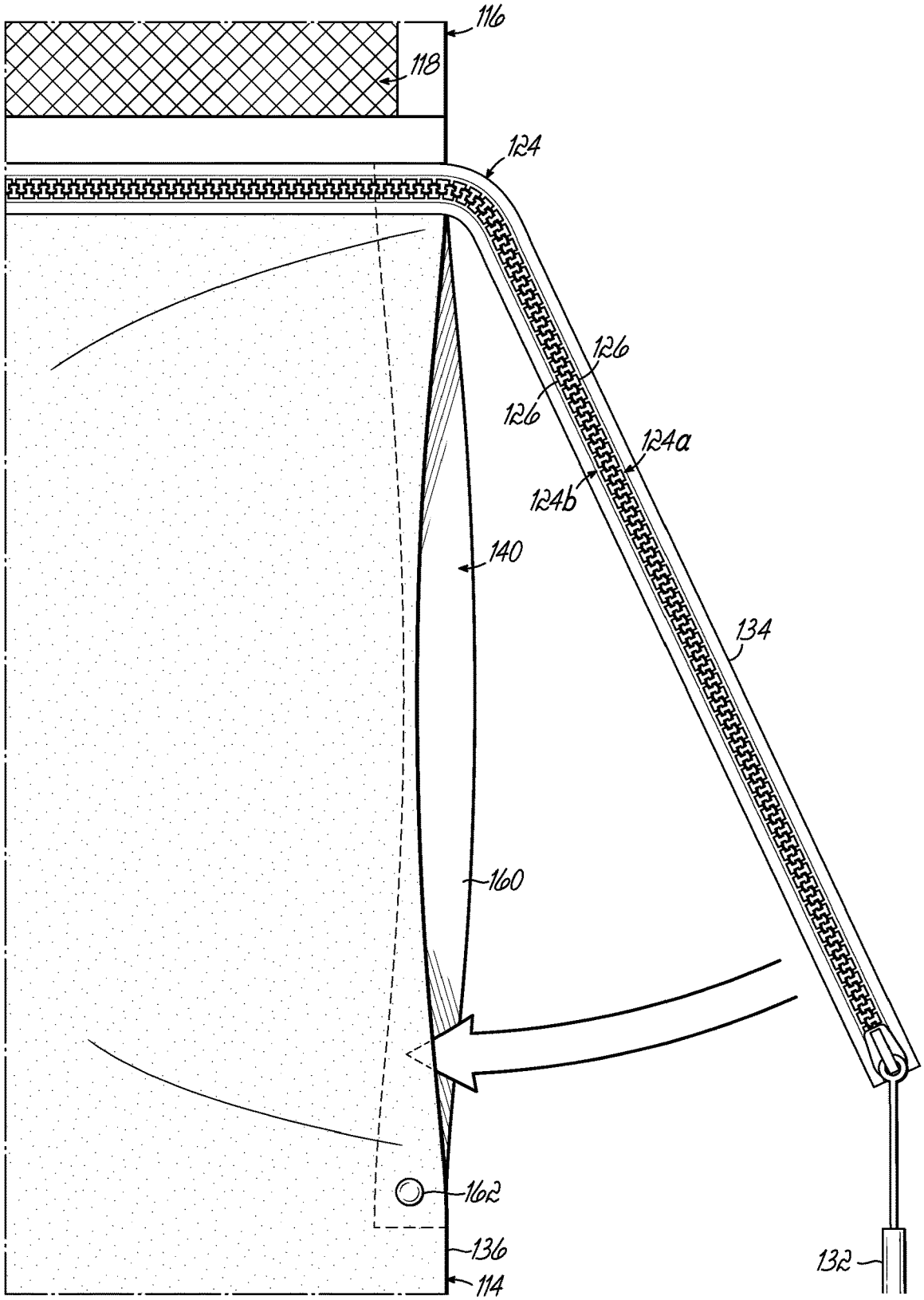
Figure 12B:
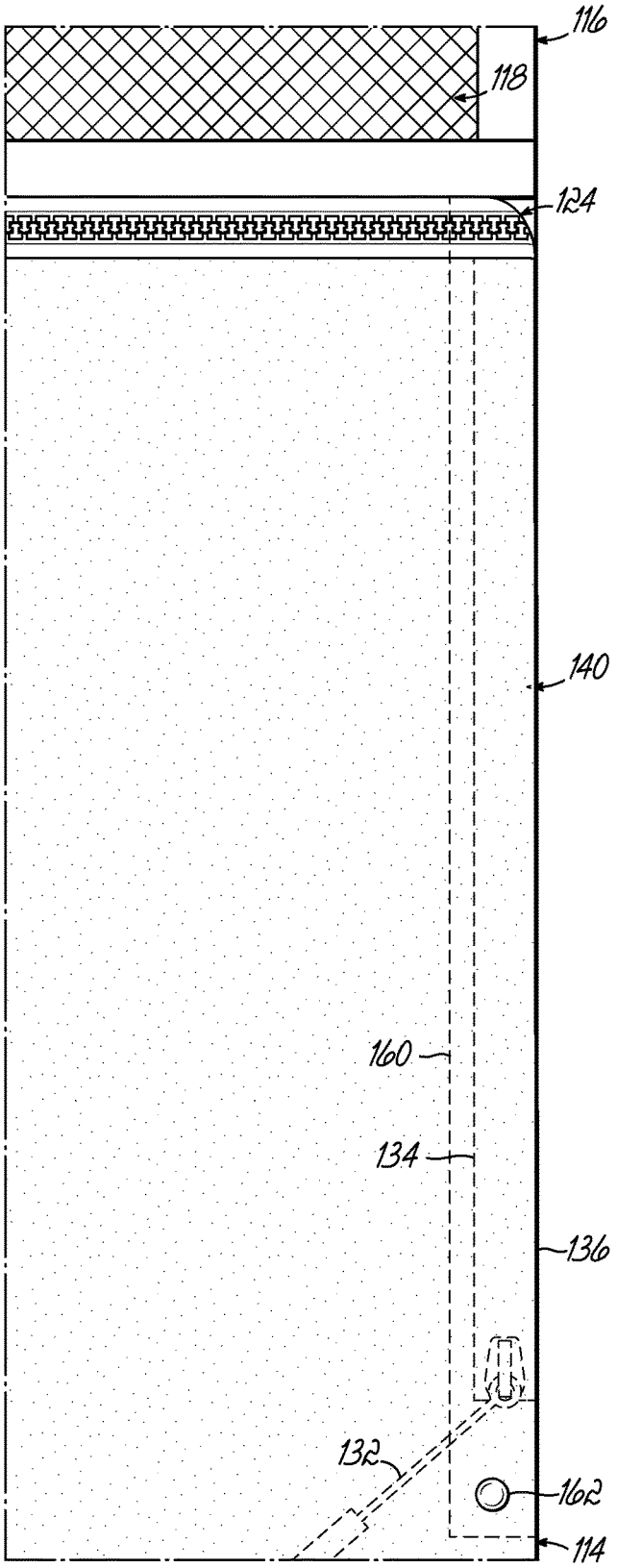
Figure 12C:
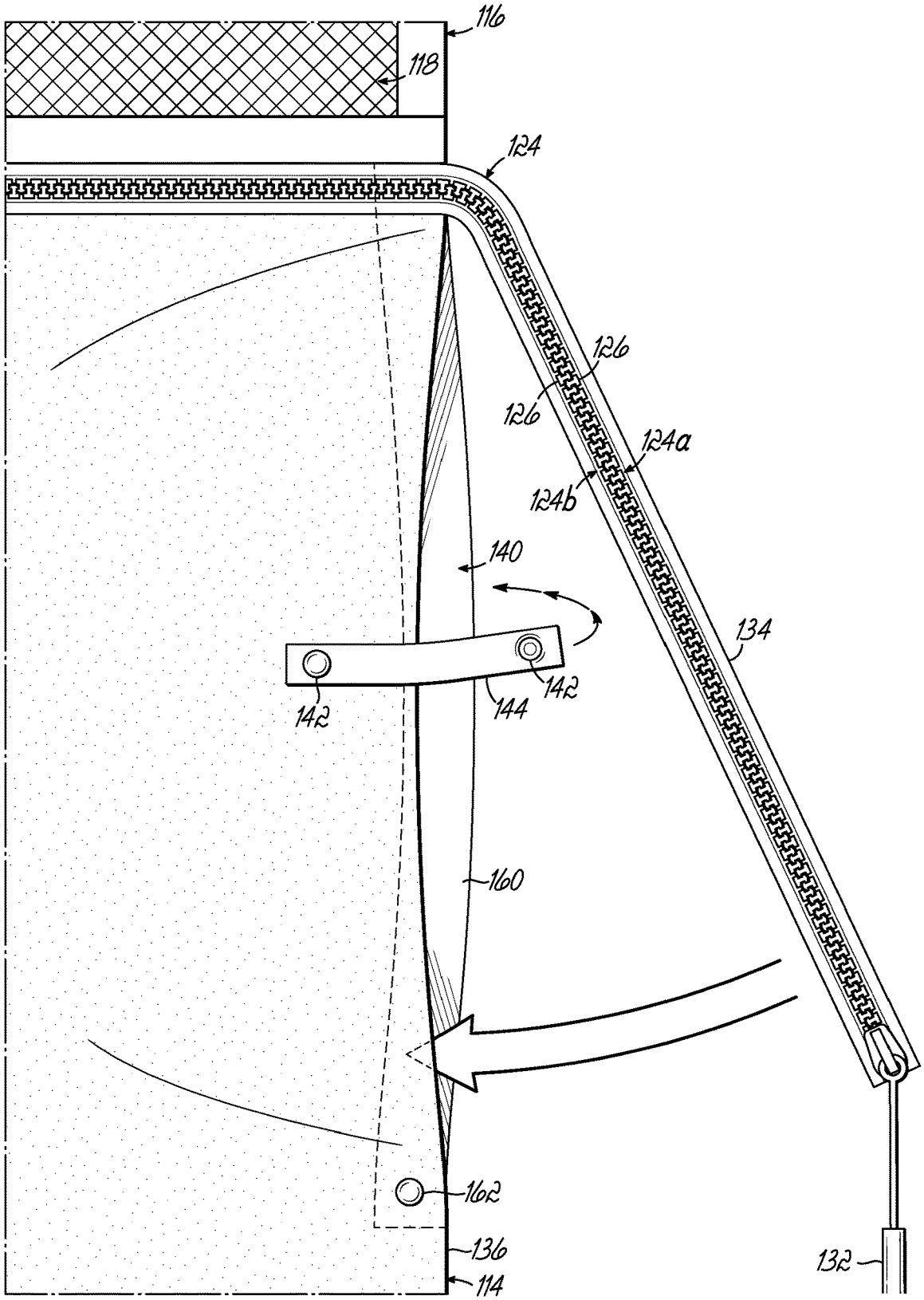
Figure 13:
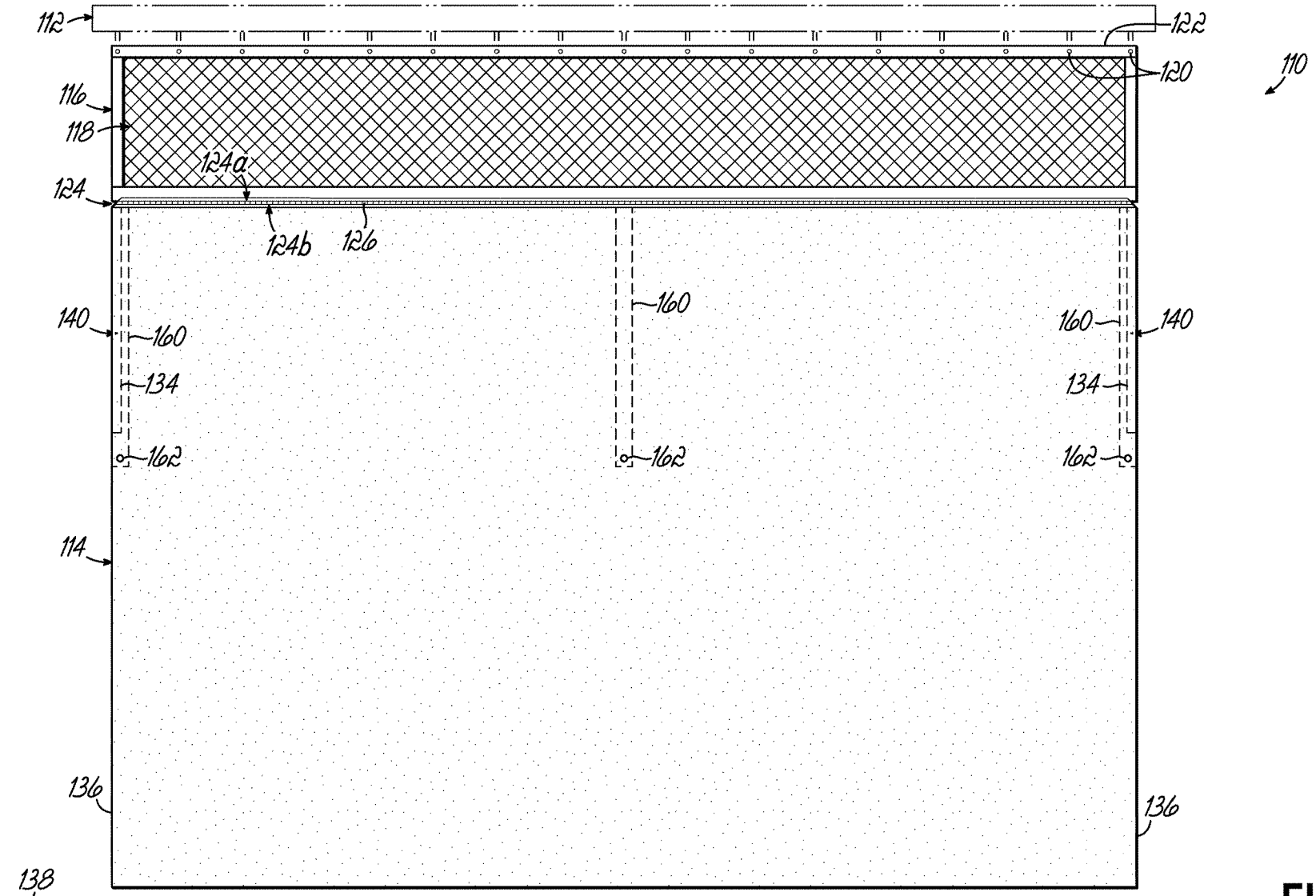
Figure 14:
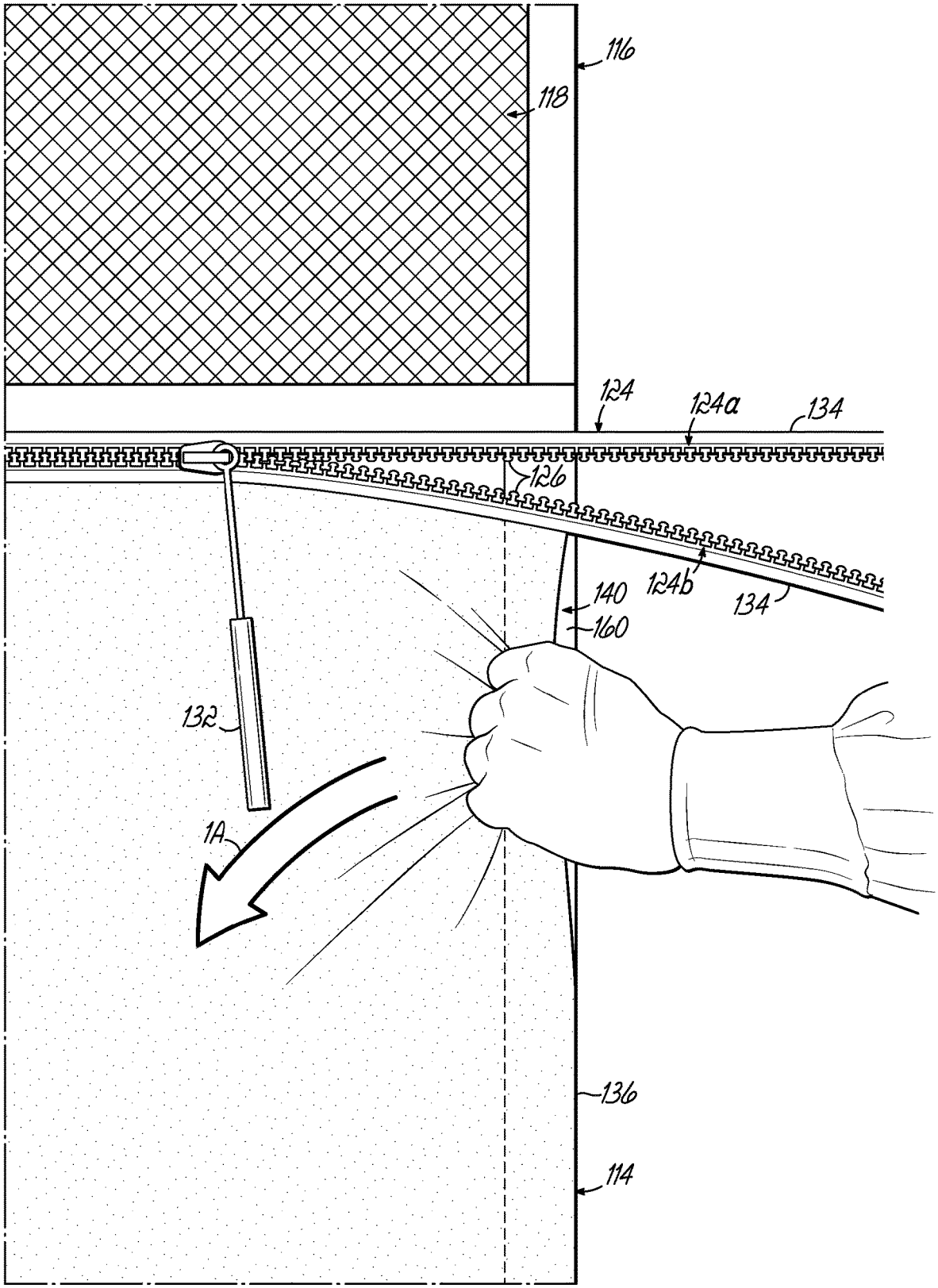
Figure 15:
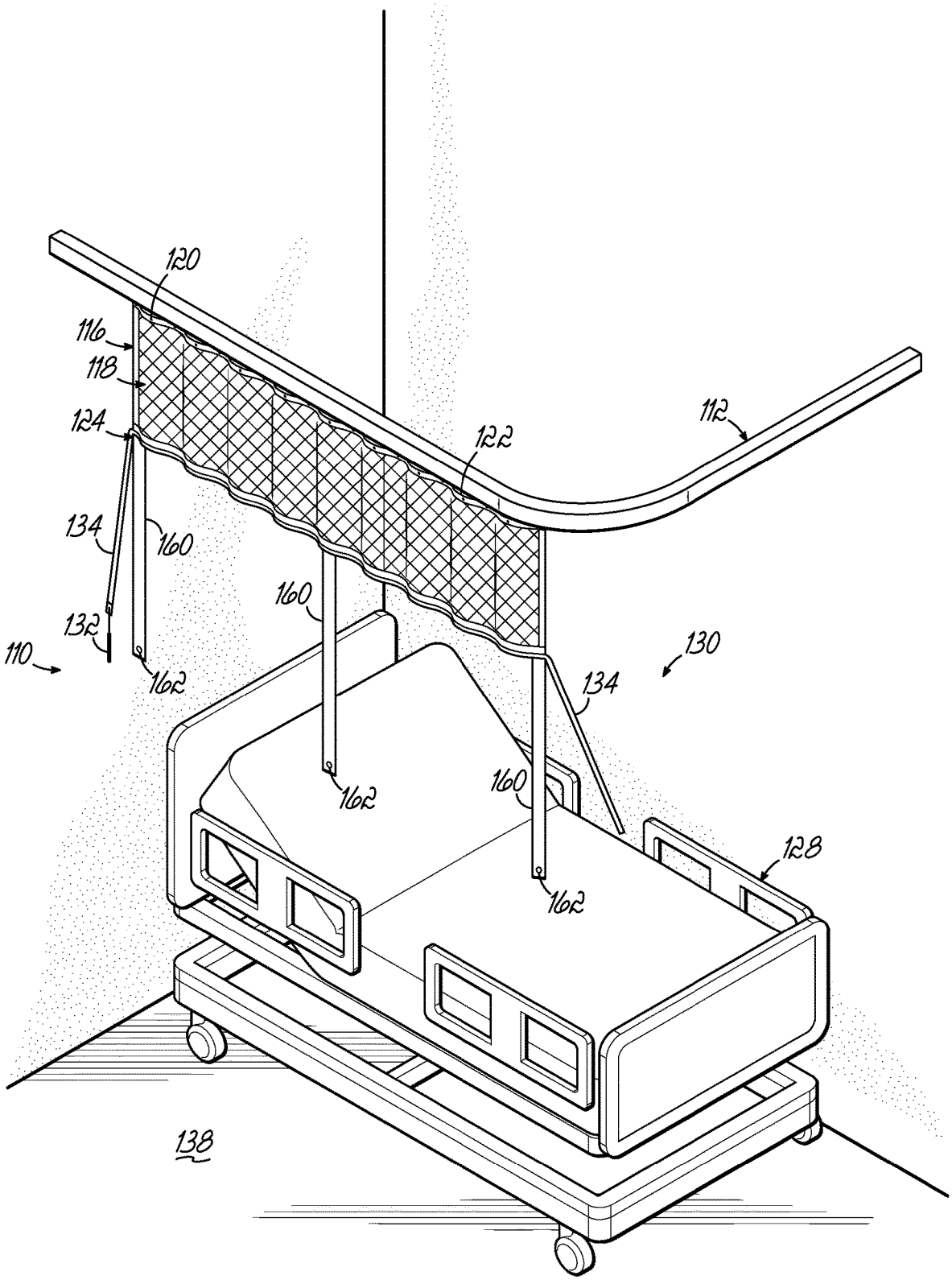
Figure 16:
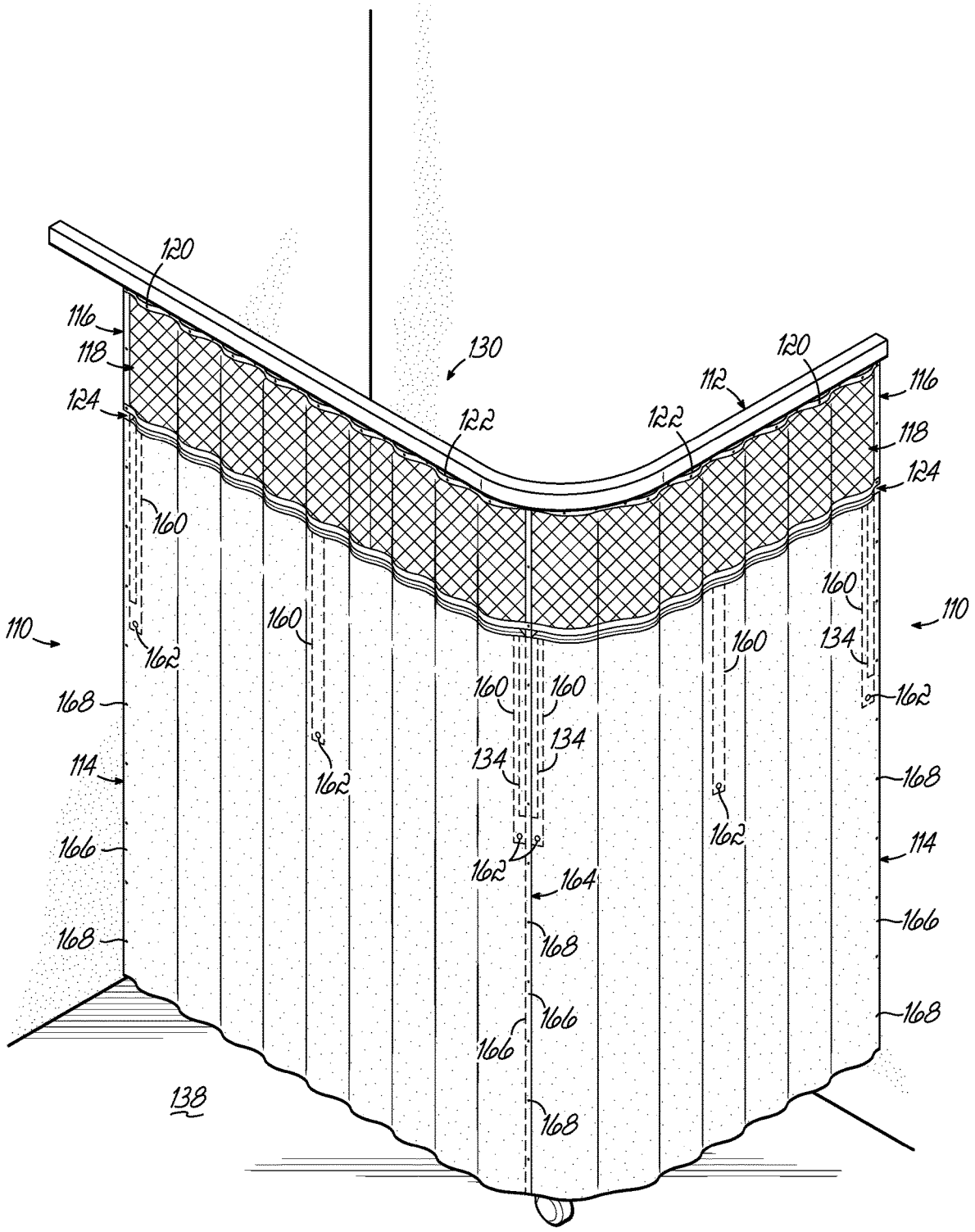
Figure 17:
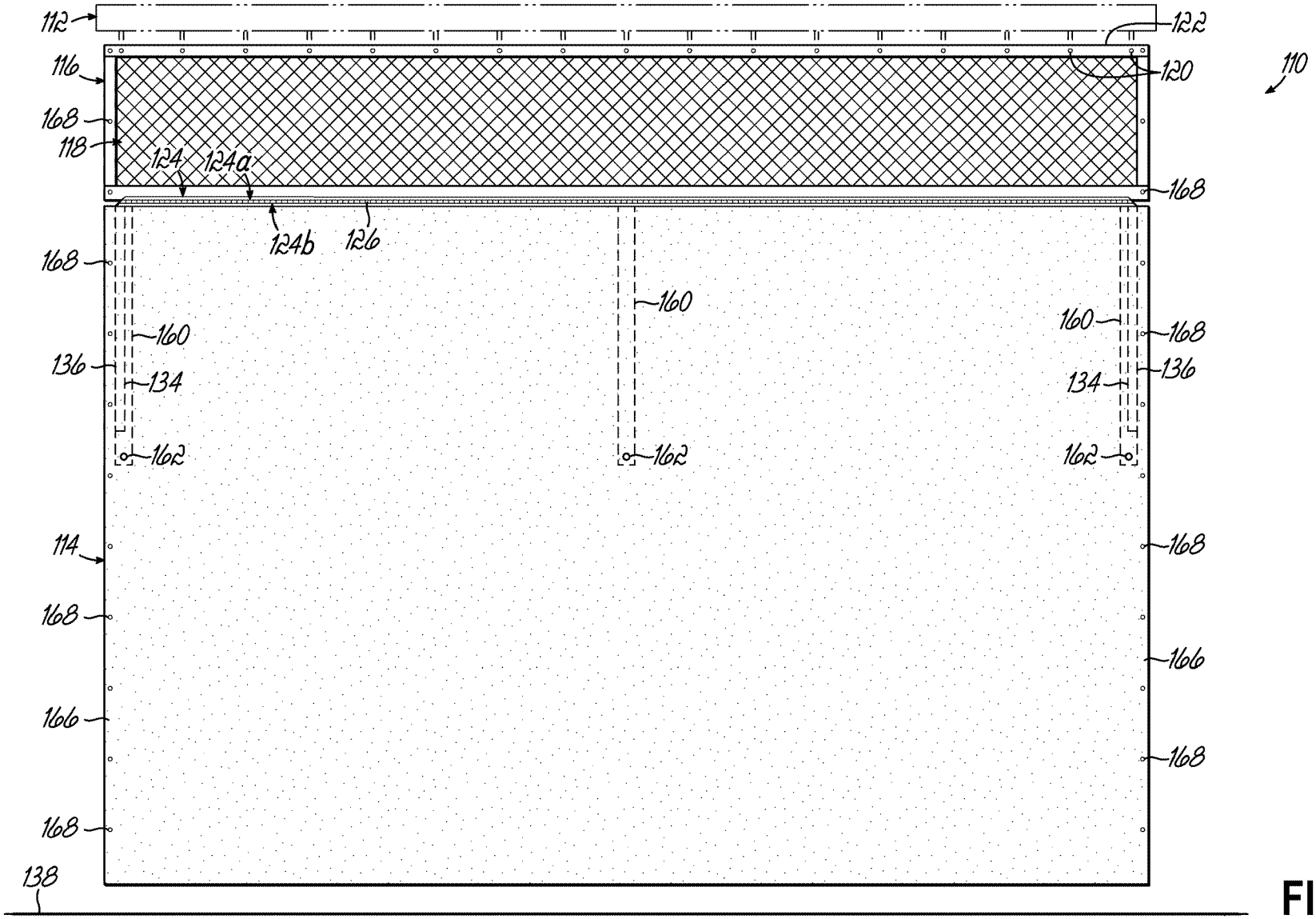
Figure 17A:
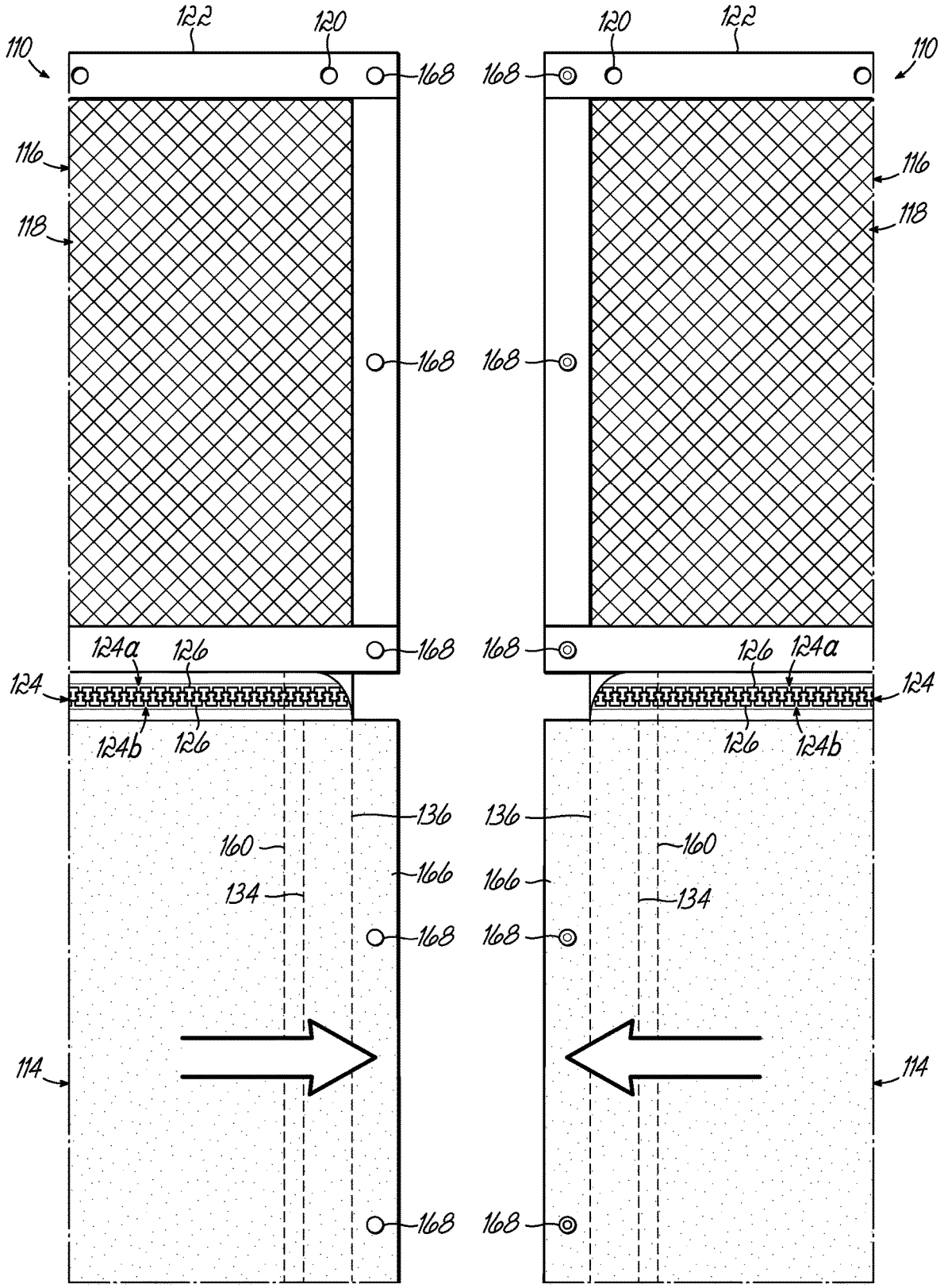
Figure 17B:
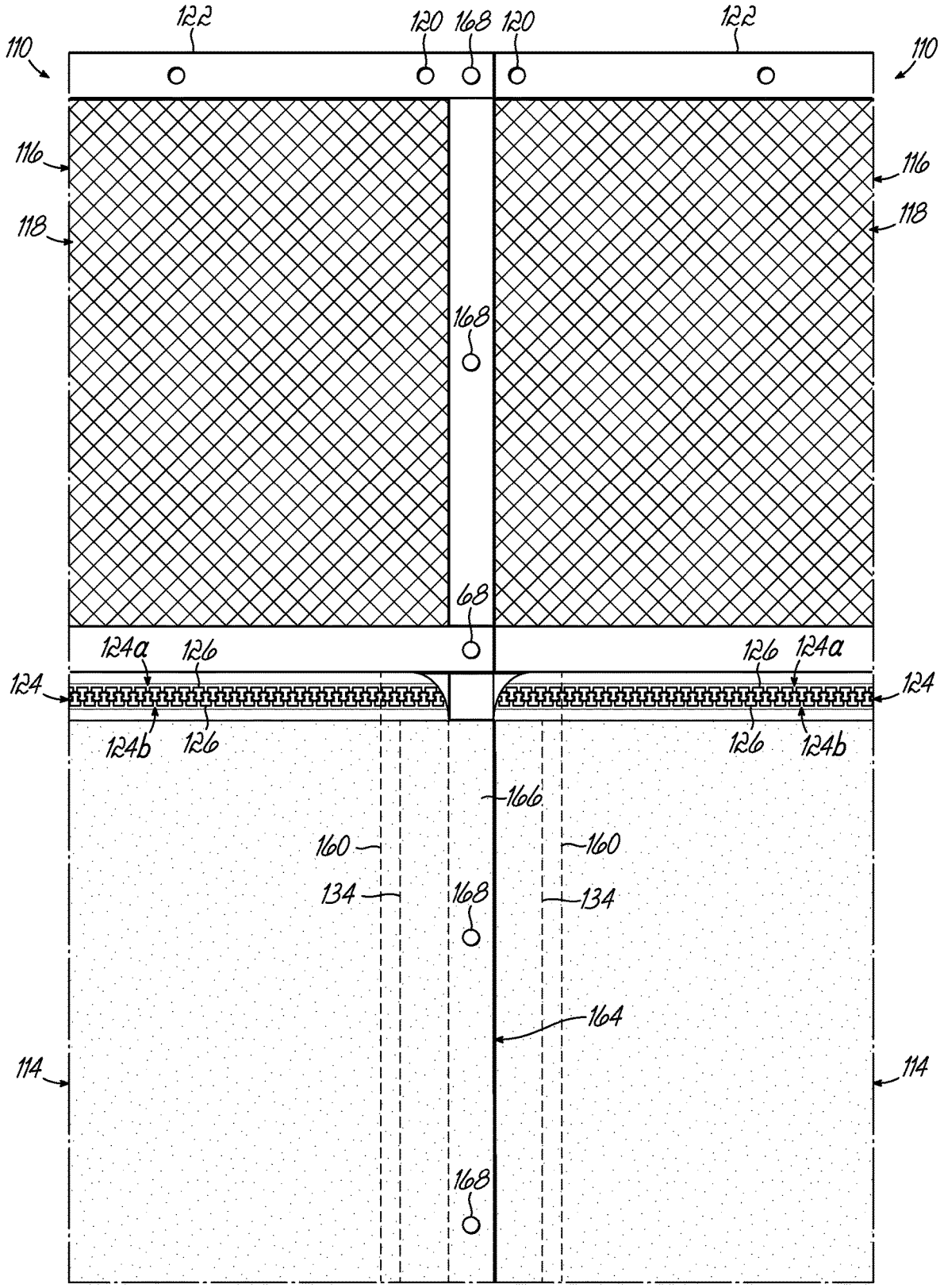

FIG. 7 is a perspective view of another embodiment of a separable curtain in a clinical setting according to this invention;

FIG. 8 is a front elevational view of a folded bottom portion of the curtain in FIG. 7 being initially attached to a strap extending from the top portion of the curtain according to one aspect of this invention;

FIG. 9 is view similar to FIG. 8 with the bottom portion secured to all of the straps on the top portion of the curtain;

FIG. 10 is a view subsequent to FIG. 9 with a zipper mechanism initially being zipped closed to join the top and bottom portions;

FIG. 11 is view subsequent to FIG. 10 showing the zipper mechanism being closed;

FIG. 11A is an enlarged view of the zipper mechanism of FIGS. 8-11 being manually pulled by a user;

FIG. 11B is an enlarged view of the zipper mechanism of FIGS. 8-11 being closed by a user using a zipper assist pole according to one aspect of this invention;

FIG. 12 is a view similar to FIGS. 9-11 showing the zipper mechanism zipped closed joining the top and bottom portions of the curtain and zipper extensions of the zipper mechanism being tucked into the bottom portion of the curtain;

FIGS. 12A-12D are sequential views of one of the zipper extensions being tucked into a pocket in the bottom portion of the curtain;

FIG. 13 is front elevational view of the curtain of FIG. 7 with the top and bottom portions joined by the zipper mechanism and the zipper extensions tucked into respective pockets according to one embodiment of this invention;

FIG. 14 is an enlarged view of a user initially separating the bottom portion from the top portion via a quick release zipper mechanism according to one embodiment of this invention;

FIG. 15 is a view similar to FIG. 7 with the bottom portion of the curtain removed for cleaning and/or replacement;

FIG. 16 is a view similar to FIG. 7 with two adjacent curtains coupled together to provide additional privacy and coverage to the clinical setting;

FIG. 17 is front elevational view of one of the curtains of FIG. 16;

FIGS. 17A-17B are sequential views of the two curtains of FIG. 17 being joined together according to one embodiment of this invention;

CCN-107B Follows

Figure 18:
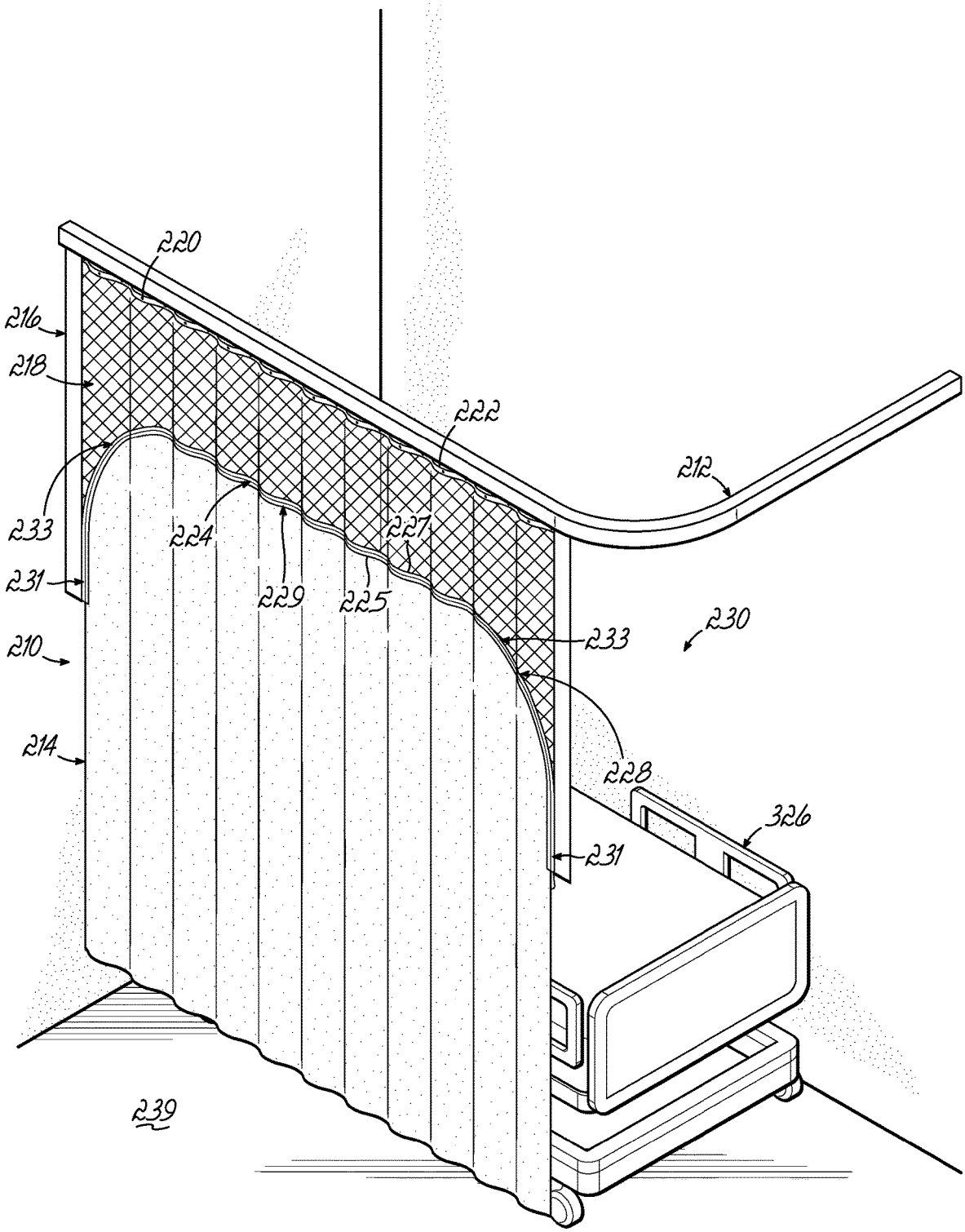
Figure 19:
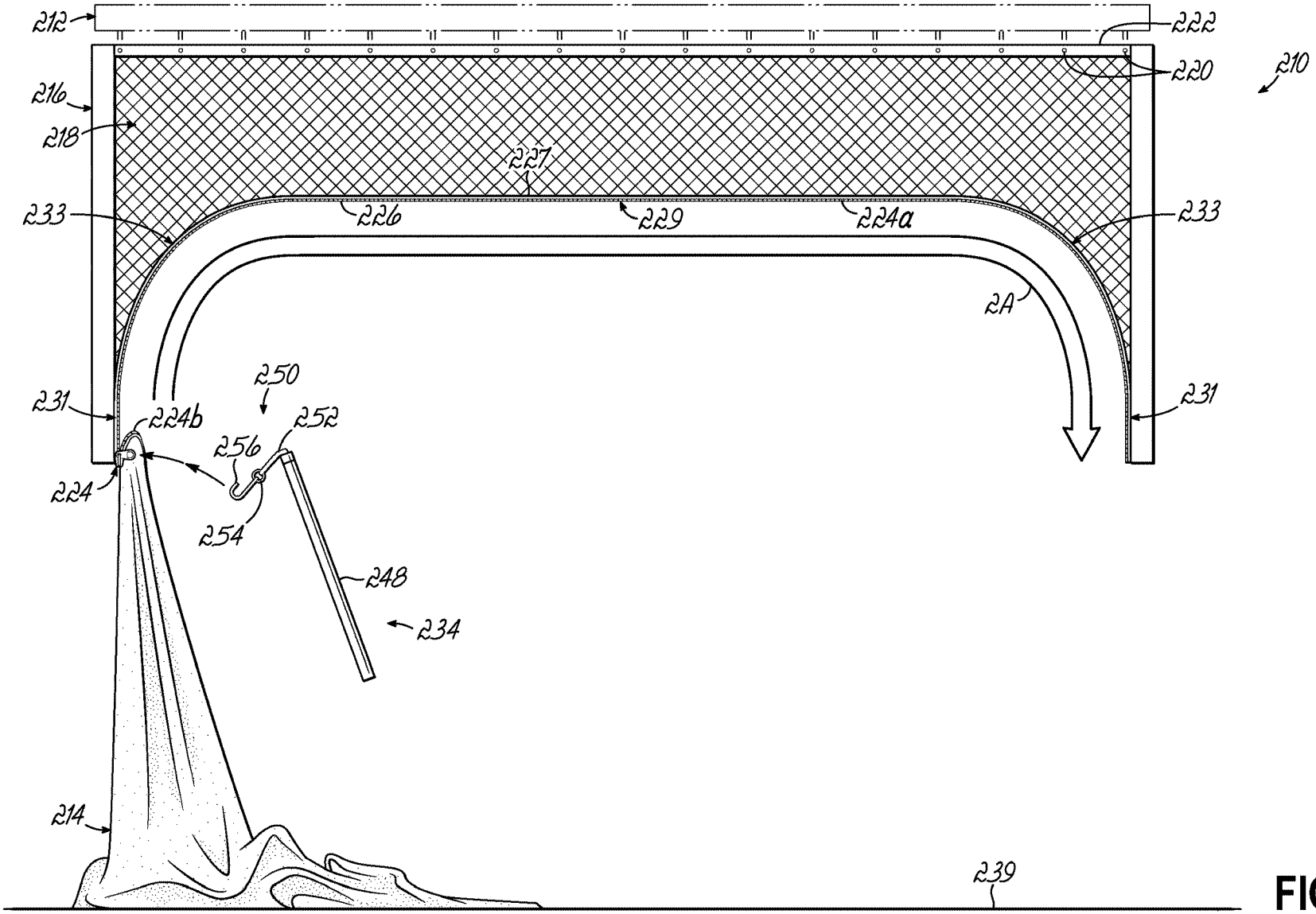
Figure 19A:
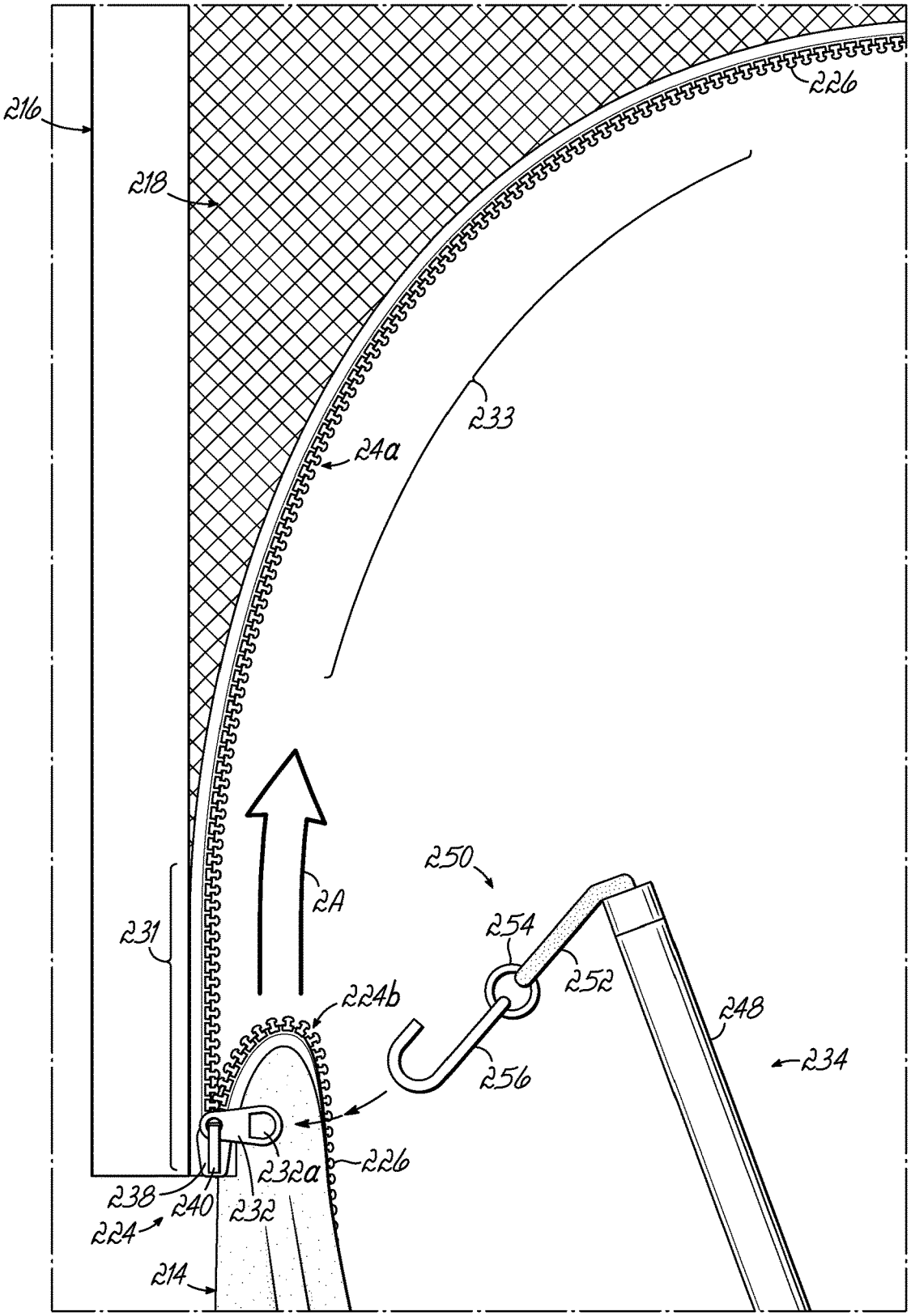
Figure 20:
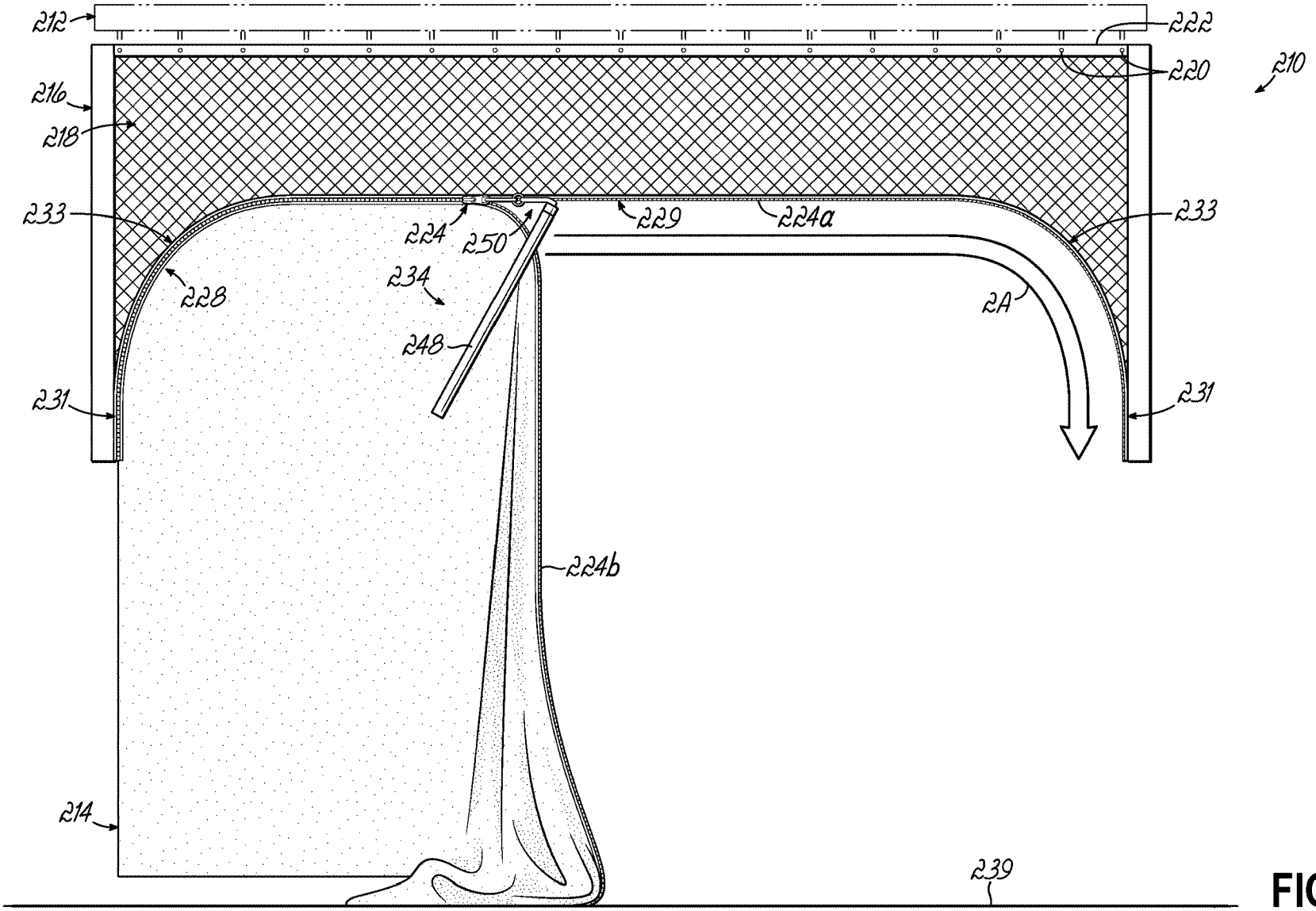
Figure 20A:
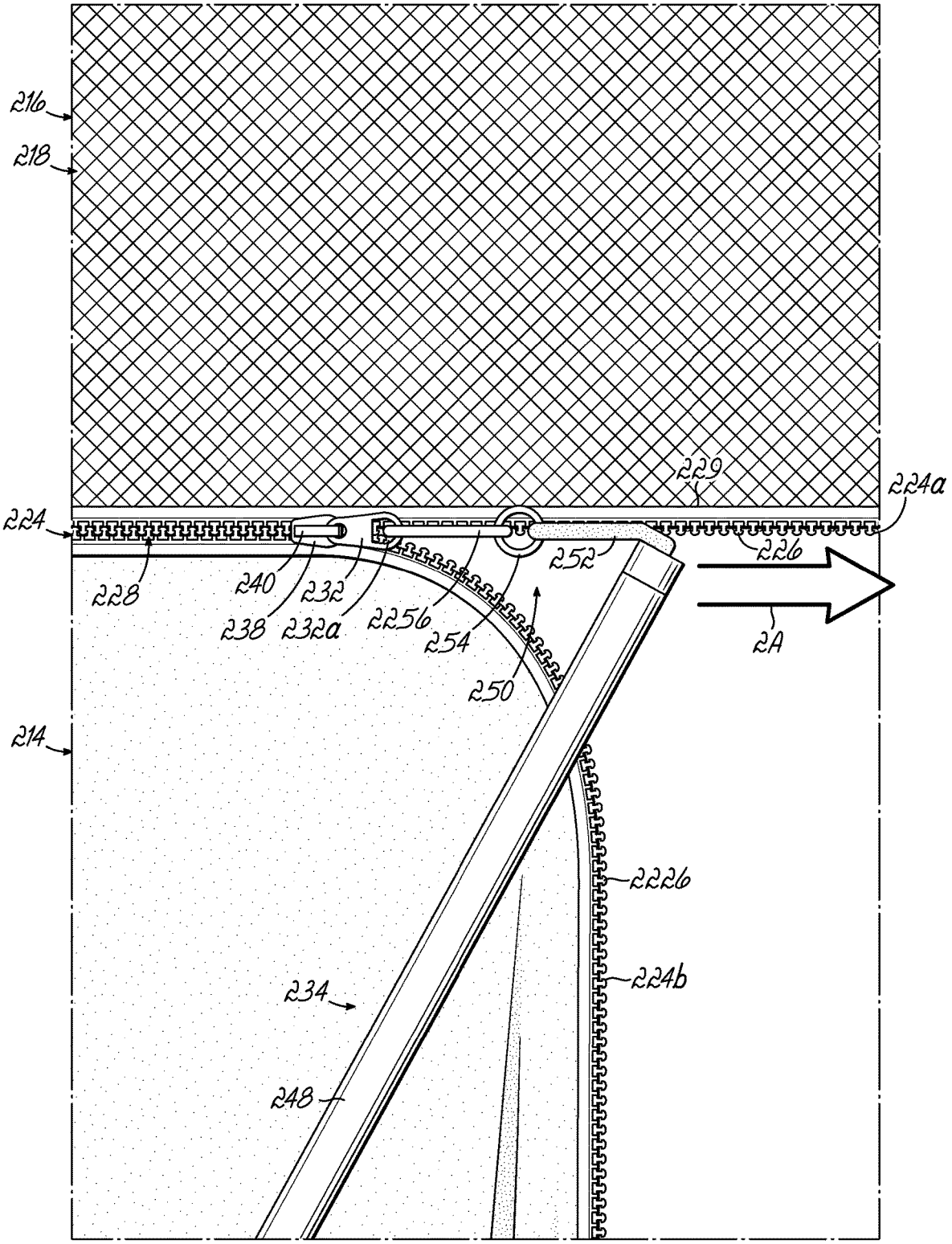
Figure 21:
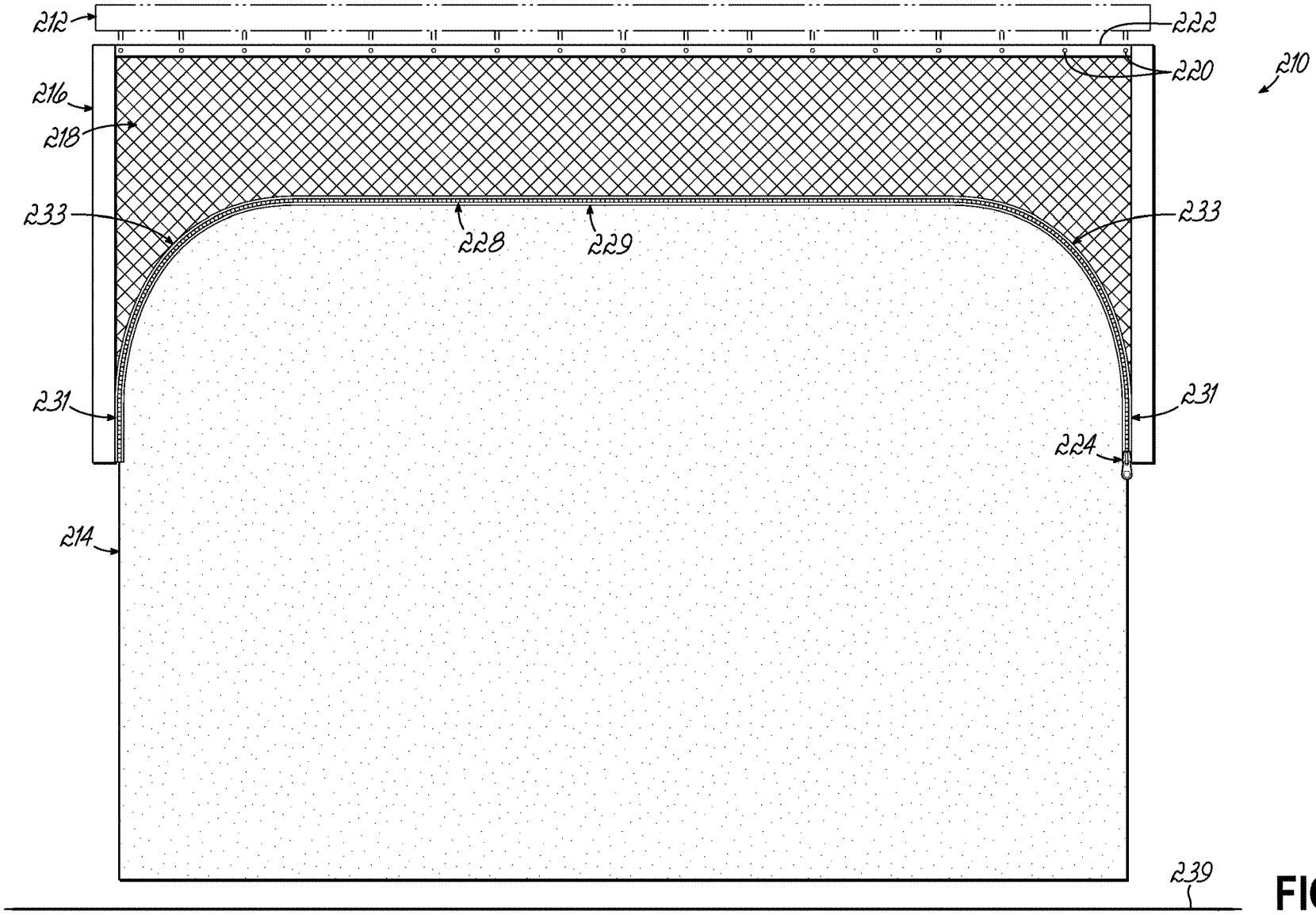
Figure 22:
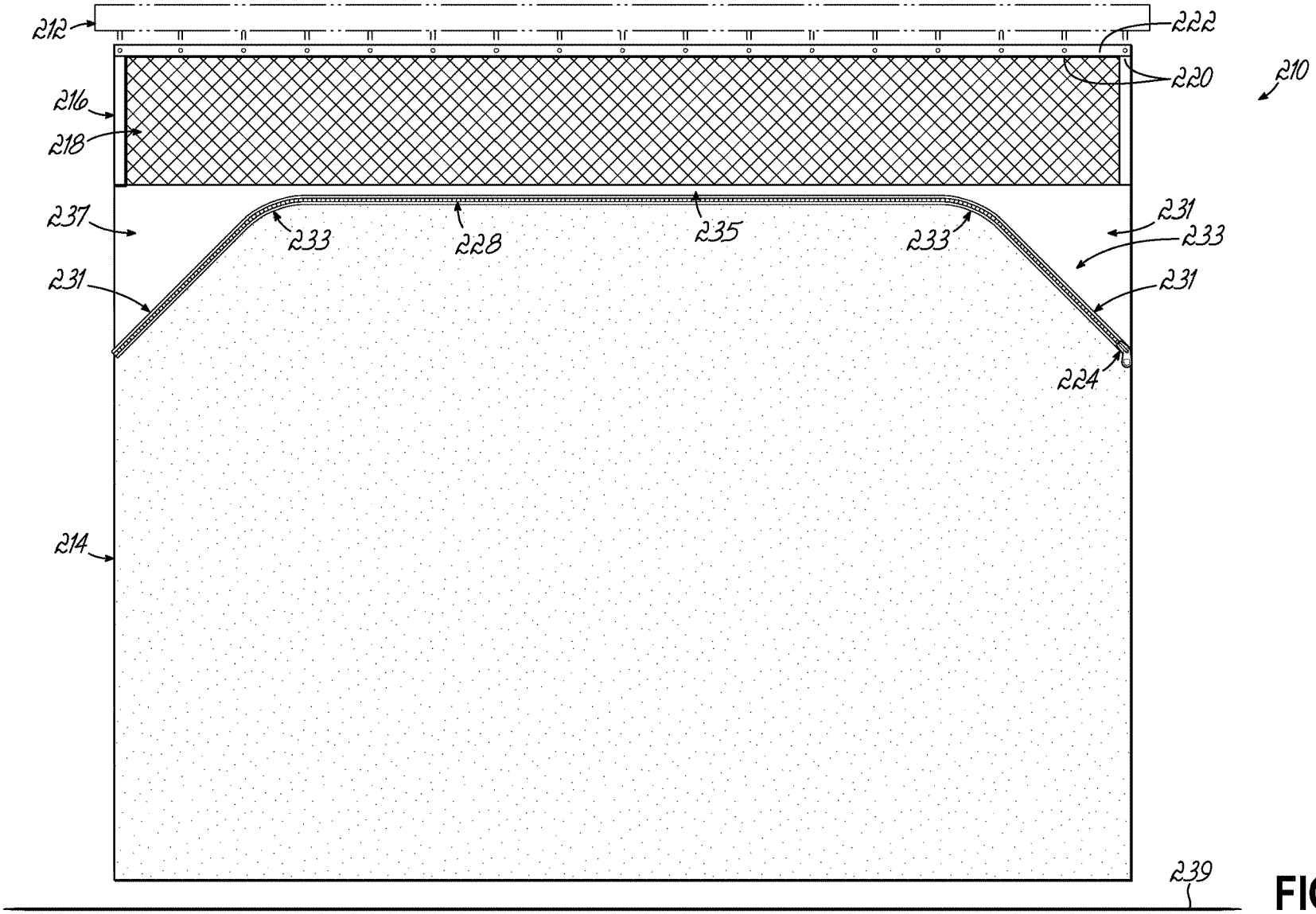

FIG. 18 is a perspective view of another embodiment of a separable curtain in a clinical setting according to this invention;

FIG. 19 is a front elevational view of a bottom portion of the curtain in FIG. 18 being initially attached to the top portion of the curtain according to one aspect of this invention;

FIG. 19A is an enlarged view of the curtain of FIG. 19 with a zipper pull being mated with the head of a zipper assist pole according to one aspect of this invention;

FIG. 20 is a view subsequent to FIGS. 19 and 19A with a zipper mechanism initially being zipped closed to join the top and bottom portions;

FIG. 20A is view subsequent to FIG. 20 showing the zipper mechanism being closed;

FIG. 21 is a front elevational view of the bottom portion of the curtain installed onto the top portion with the zipper mechanism zipped closed according to one embodiment of this invention; and FIG. 22 is a view similar to FIG. 21 of an alternative embodiment of the curtain of this invention.

DETAILED DESCRIPTION OF THE INVENTION

Turning now to the drawings, in which similar reference characters denote similar elements throughout the several views. With regard to the reference numerals used, the following numbering is used throughout the various drawing figures. The following discussion describes in detail at least one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Figure 1:
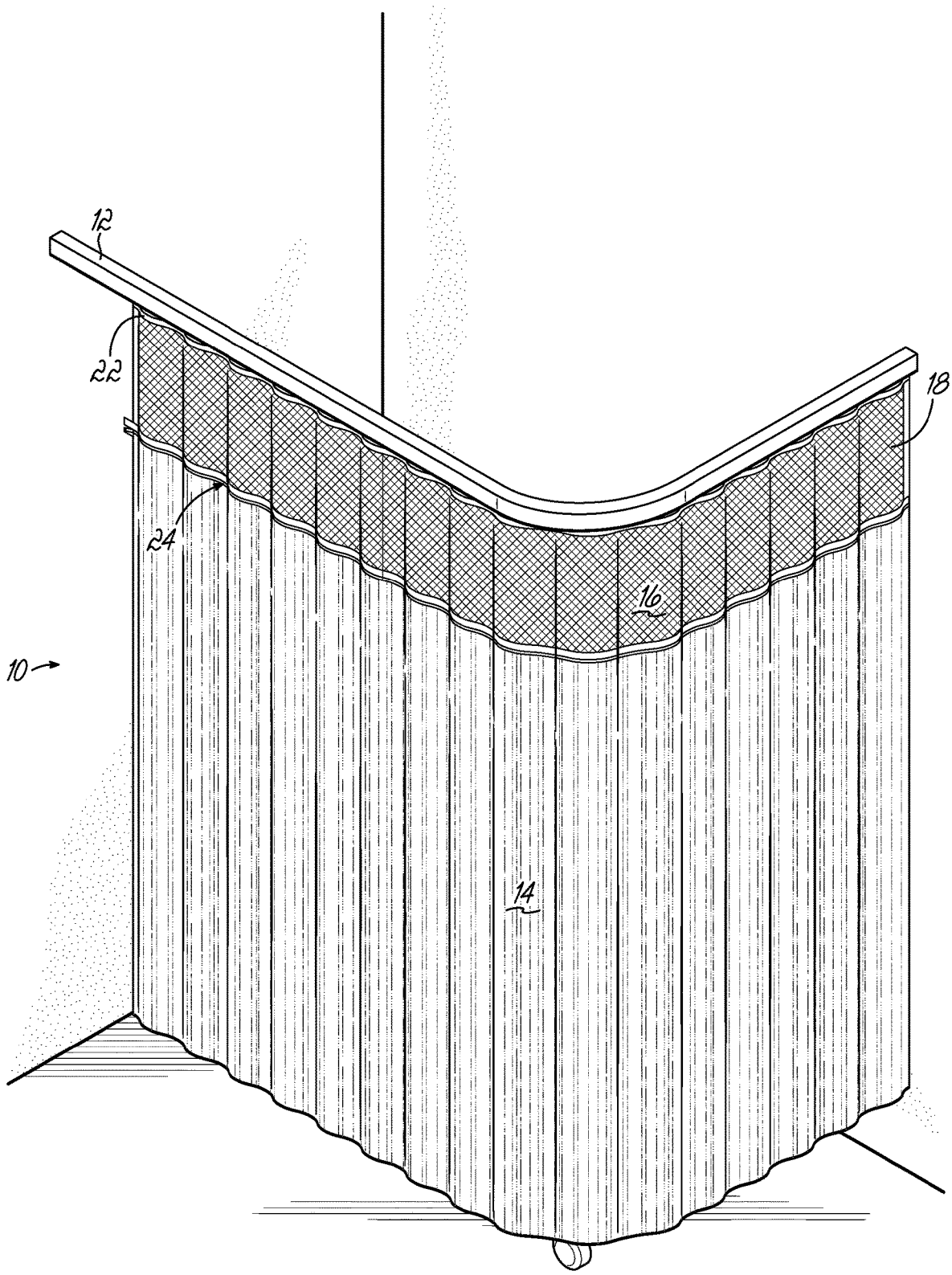
FIG. 1 is a perspective view of one embodiment of a separable curtain in a clinical setting according to this invention.

FIG. 1 is a perspective view of one embodiment of this invention being a curtain assembly 10 suspended from a track 12, showing a lower portion 14 separable from an upper portion 16. This embodiment of the invention is a quick release hospital curtain 10 comprising the lower portion 14 which may be fabricated out of an antimicrobial fabric. The invention also includes a ventilated upper portion 16. The upper portion 16 has a top segment made of a mesh material 18 for ventilation and is slideably attached along a ceiling track 12 using a number of curtain carriers coupled to spaced apart eyelets 20 on a top edge 22 of the upper portion 16. A breakaway zipper 24 extends longitudinally between the lower portion 14 and the upper portion 16 of the hospital curtain 10. The breakaway zipper 24 has upper and lower zipper tracks 24*a*, 24*b* with matingly interlocking teeth 26 that are separable for removing the lower portion 14 from the upper portion 16 of the hospital curtain 10 when desired.

FIG. 1 is a perspective view of this embodiment of this invention fully assembled. Shown is the quick release curtain 10 of this invention comprising the lower portion 14 and the ventilated upper portion 16. A number of different materials may be used for the lower portion 14. Various antimicrobial materials may be topically applied periodically or they may be impregnated within the curtain material during the manufacturing process. This provides an impediment to germs in the environment surrounding the bed 28 or examination area 30 (FIG. 6) by denying a surface where the organisms can multiply. The breakaway zipper 24 (discussed further below) extends fully from the left edge of the hospital curtain 10 to the right edge of the hospital curtain 10. The breakaway zipper 24 has upper and lower zipper tracks 24*a*, 24*b* with matingly interlocking teeth 26 that are separable for removing the lower portion 14 from the upper portion 16 when the matingly interlocking teeth 26 are disengaged from one another.

Figure 2:
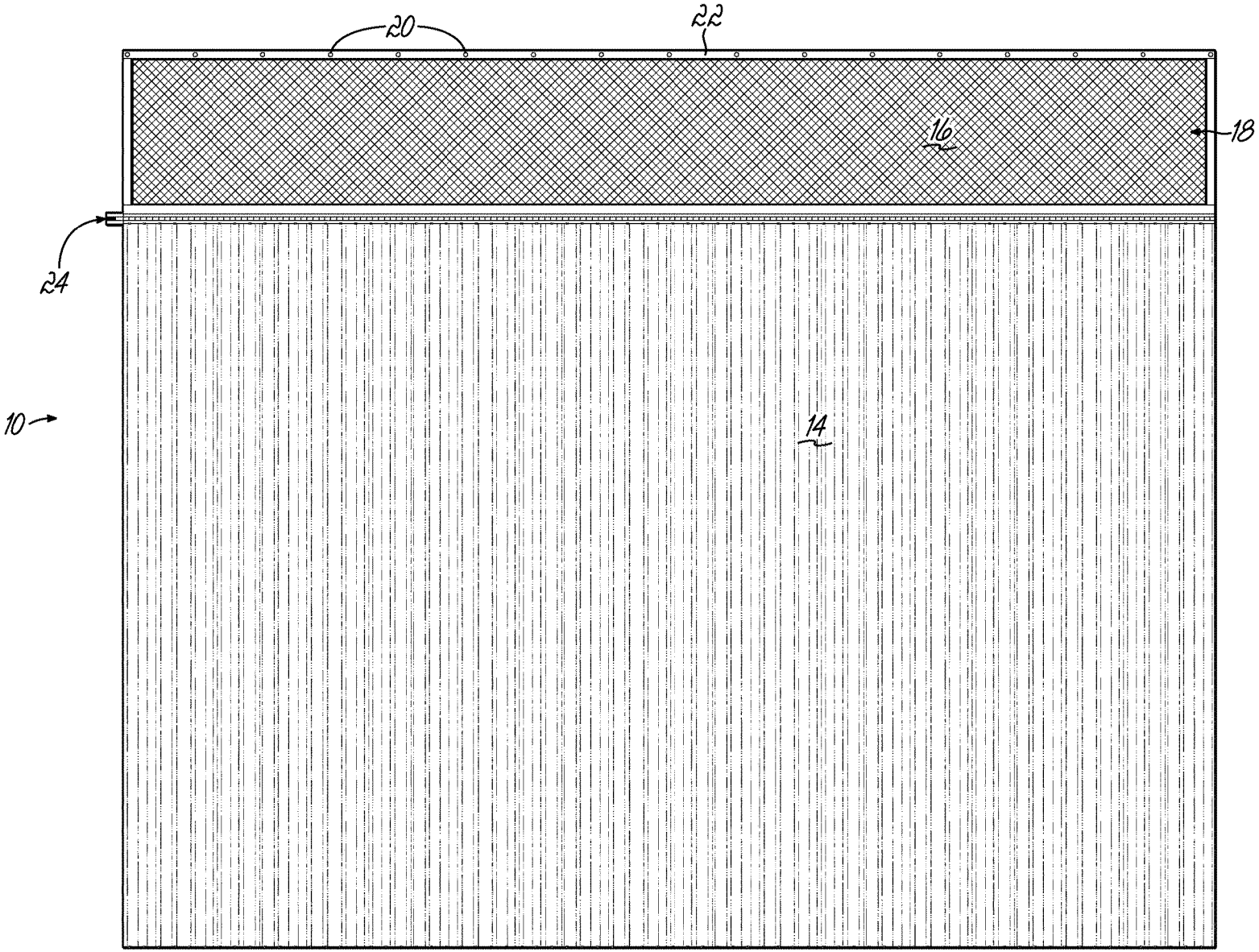
FIG. 2 is a front elevational view of the curtain in FIG. 1 in a generally planar configuration.

FIG. 2 is a front view of the curtain 10 in a generally planar configuration and suspended off of the ceiling track 12.

Figure 3:
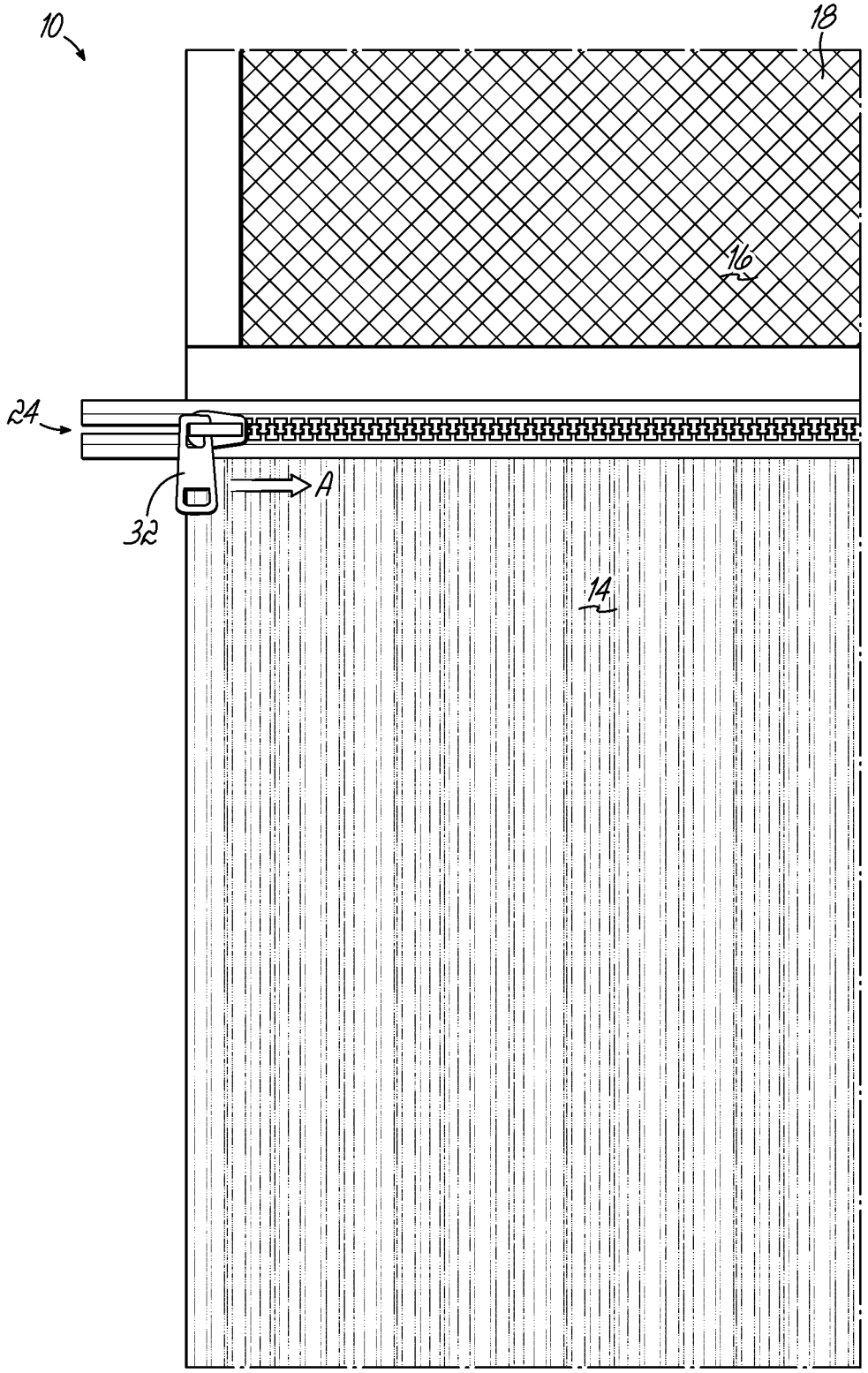
FIG. 3 is an enlarged view of a portion of the curtain of FIG. 2.
Figure 4:
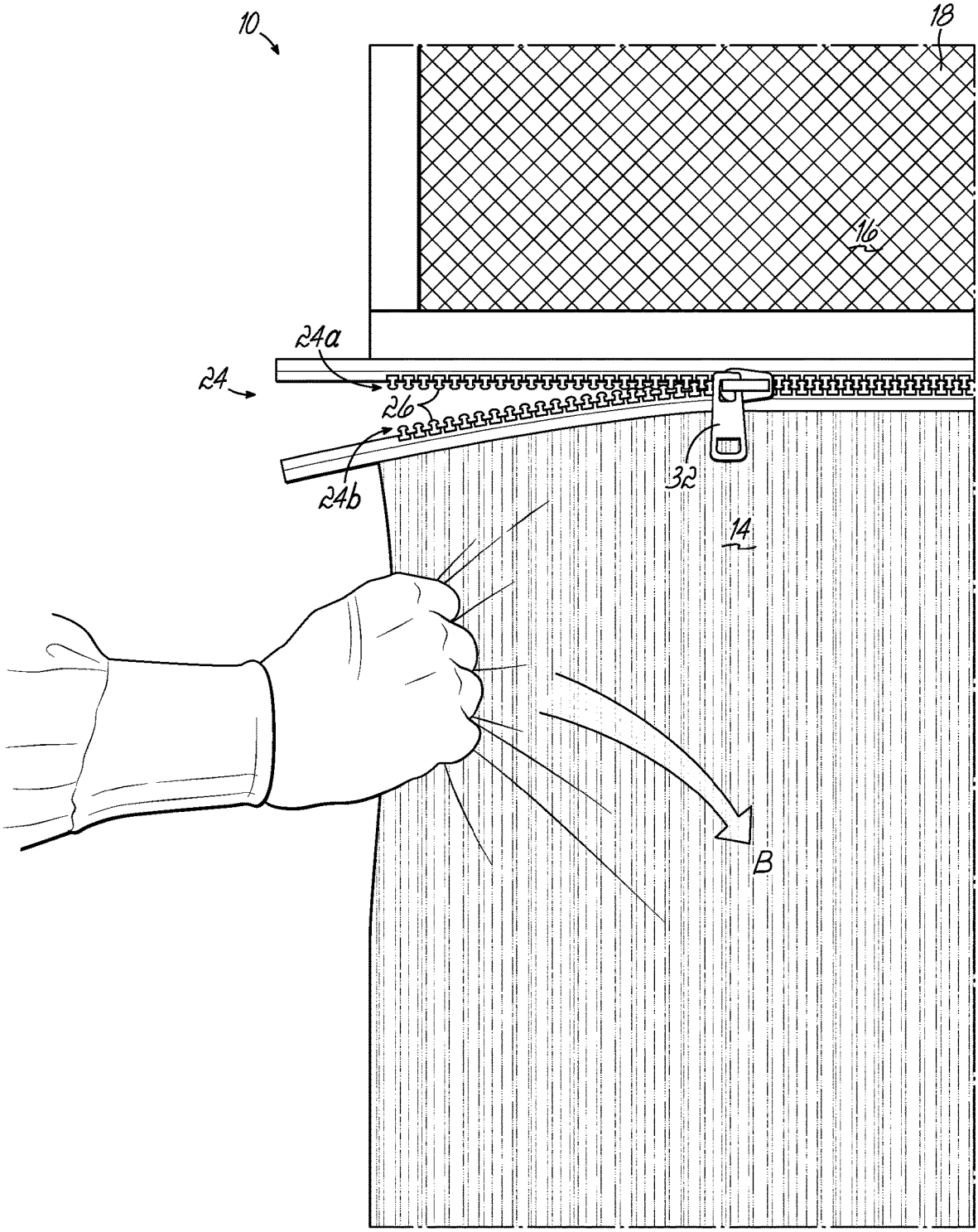
FIG. 4 is a view similar to FIG. 3 with a user separating portions of the curtain along a zipper.

FIGS. 3-4 are front views of this embodiment of this invention similar to FIG. 2, showing the lower portion 14 starting to be separated from the upper portion 16. The quick release hospital curtain 10 of this invention includes the breakaway zipper 24 which extends from the left edge of the hospital curtain 10 to the right edge of the hospital curtain 10. This breakaway zipper 24 provides a combined breakaway and engagement means that allows a user to remove the lower portion 14 from the upper portion 16 when desired, as will be discussed below. In one embodiment, the interlocking teeth 26, are made of a polymer substance and may also be impregnated or infused with an antimicrobial compound similar to the lower portion 14 of the hospital curtain 10. The zipper 24 may be separated by a user pulling the handle 32 of the zipper 24 in the direction of arrow A in FIG. 3. Note also that it is contemplated that in the case of an emergency, if the curtain 10 needed to be removed more quickly, the interlocking zipper teeth 26, could be disengaged from one another by simply pulling downwardly as indicated at directional arrow B in the FIG. 4, which would also cause the zipper tracks 24*a*, 24*b* to detach from one another.

Figure 5:
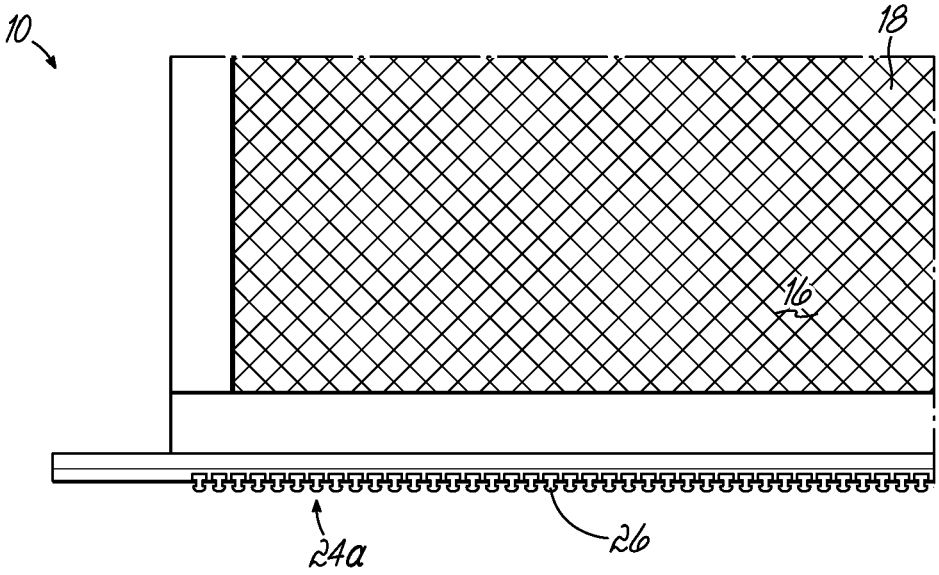
FIG. 5 is view similar to FIGS. 3 and 4 with a portion of the curtain removed along the zipper.

FIG. 5 is an enlarged partial front view of the upper portion 16 with the lower portion 14 broken away. The breakaway zipper 24 is shown with the upper zipper track 24*a*.

Shown in FIG. 5 is a detailed view of the quick release hospital curtain 10 of this one embodiment of this invention with the lower portion 14 removed. The breakaway zipper 24 extends from the left edge of the hospital curtain 10 to the right edge of the hospital curtain 10. The breakaway zipper 24 has the upper and lower zipper tracks 24*a*, 24*b* with the matingly interlocking teeth 26 that are separable for removing the lower portion 14 from the upper portion 16 when the matingly interlocking teeth 26 are disengaged.

Figure 6:
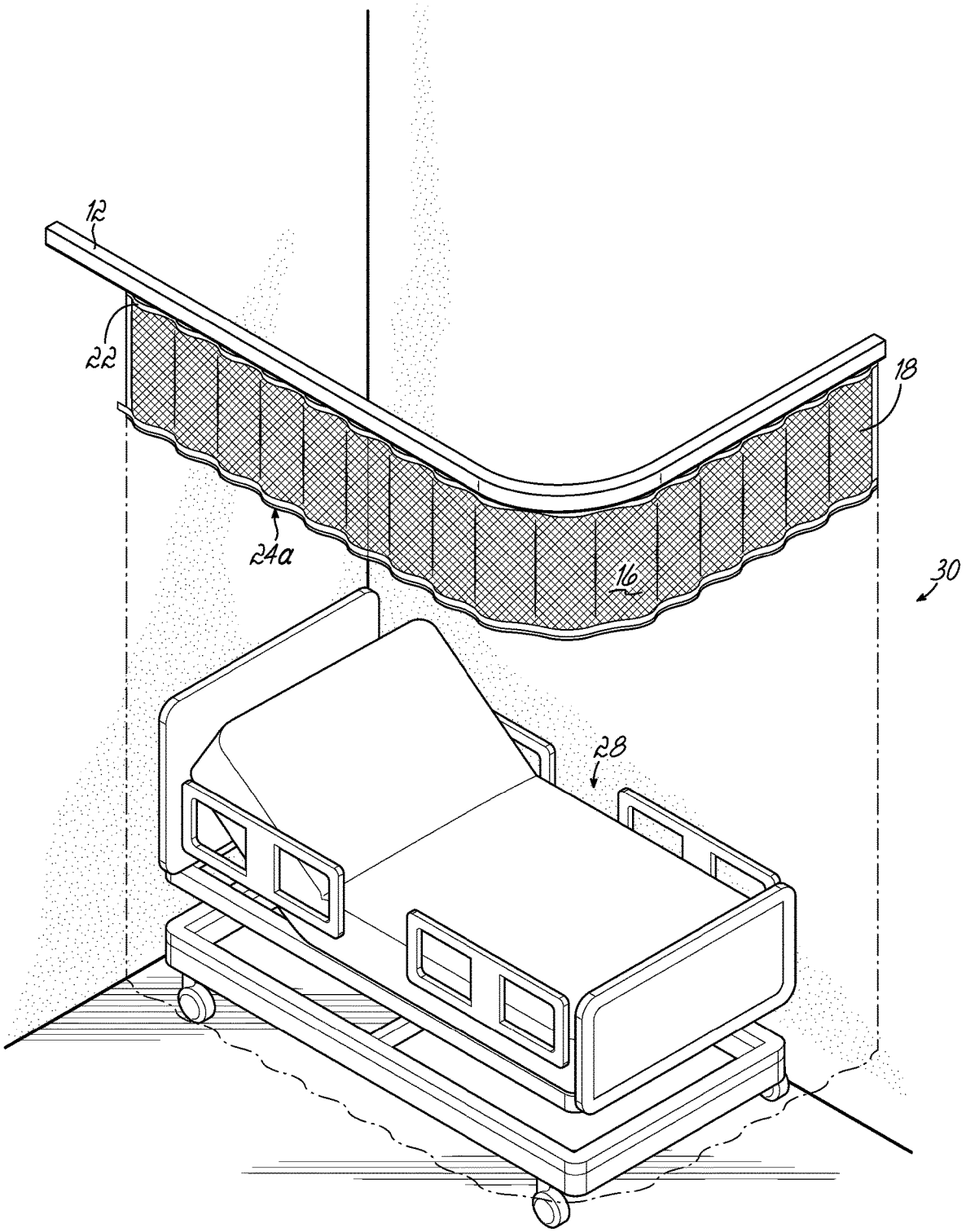
FIG. 6 is a view similar to FIG. 1 with the portion of the curtain removed and shown in phantom lines.

FIG. 6 is an enlarged perspective view of the clinical setting 30 similar to FIG. 1, showing the zipper 24 opened and the lower portion 14 removed away from the upper portion 16. The breakaway zipper 24 has the upper and lower zipper tracks (24*a* and 24*b*, respectively) with matingly interlocking teeth 26 that are separable for removing the lower portion 14 from the upper portion 16 when the matingly interlocking teeth 26 are disengaged as shown. As mentioned above, the user (seen in FIG. 4) may either use the zipper handle 32, indicated in FIG. 3, or may, in case of urgency, simply pull the engaged teeth 26 apart as shown in FIG. 4.

This invention in various embodiments provides a privacy curtain 10 for hospital room or examination room 30 use. With the rise of infections contracted in hospitals, some of these being partially or substantially resistant to antibiotic treatment, this invention addresses a real need by denying any airborne organisms or germs unknowingly carried by a person in the environment a surface proximate the patient where the pathogens can rest or multiply. As mentioned above, the lower portion 14 of the curtain 10 may be contaminated and this invention allows for more frequent cleaning and/or replacement. It is contemplated that the lower portion 14 of the invention would be easily washable and able to undergo sterilization procedures (high temperatures, chemical treatment, or the like) in case of being removed.

FIG. 7 is a perspective view of another embodiment of this invention being a curtain assembly 110 suspended from a track 112, showing a wide bottom portion 114 separable from a narrow top portion 116. The top portion 116 may have a top segment made of a mesh material 118 for ventilation and is slideably attached along a ceiling track 112 using a number of curtain carriers coupled to spaced apart eyelets 120 on a top edge 122 of the top portion 116. An attachment mechanism which in some embodiments is a zipper mechanism 124 extends longitudinally between and selectively joining the bottom portion 114 and the top portion 116 of the hospital curtain 110. Other attachment mechanisms may be used within the scope of this invention. The zipper mechanism 124 has upper and lower zipper tracks 124*a*, 124*b* with matingly interlocking teeth 126 that are separable for selectively removing/attaching the bottom portion 114 from/to the top portion 116 of the curtain 110 when desired.

According to various embodiments of this invention, the zipper mechanism 124 may include one or more zipper extensions 134 each of which extend beyond a side edge 136 of the curtain 110. The curtain 110 has a perimeter edge which includes the side edges 136. As shown in FIGS. 8-11, the zipper extension 134 may extend downwardly from the joint between the top portion 116 and the bottom portion 114 to thereby allow a user standing on the floor 138 to reach the zipper mechanism 124 via the zipper extension 134 and zip or unzip the zipper mechanism 124. Each zipper extension 134 is a continuation of the zipper mechanism 124 joining the top and bottom portions 116, 114 together and may include a terminus of the zipper. Just like the main portion of the zipper mechanism 124 located between the bottom and top portions 114, 116 and the side edges 136 of the portions 114, 116, each zipper extension 134 includes the upper and lower zipper tracks 124*a*, 124*b* with matingly interlocking teeth 126. Zipper extensions 134 may extend beyond and be included one or both lateral side edges 136 of the curtain 110 according to various embodiments of this invention. Each zipper extension 134 may be of any desired length to accommodate the hospital setting 130, ceiling height, height of the joint between the bottom and top and portions 114, 116 and in various embodiments may be about eighteen to twenty four inches in length. If the curtain 110 includes zipper extensions 134 on each side 136, the zipper extensions 134 do not need to be of equal length according to some embodiments of this invention.

Figure 12D:
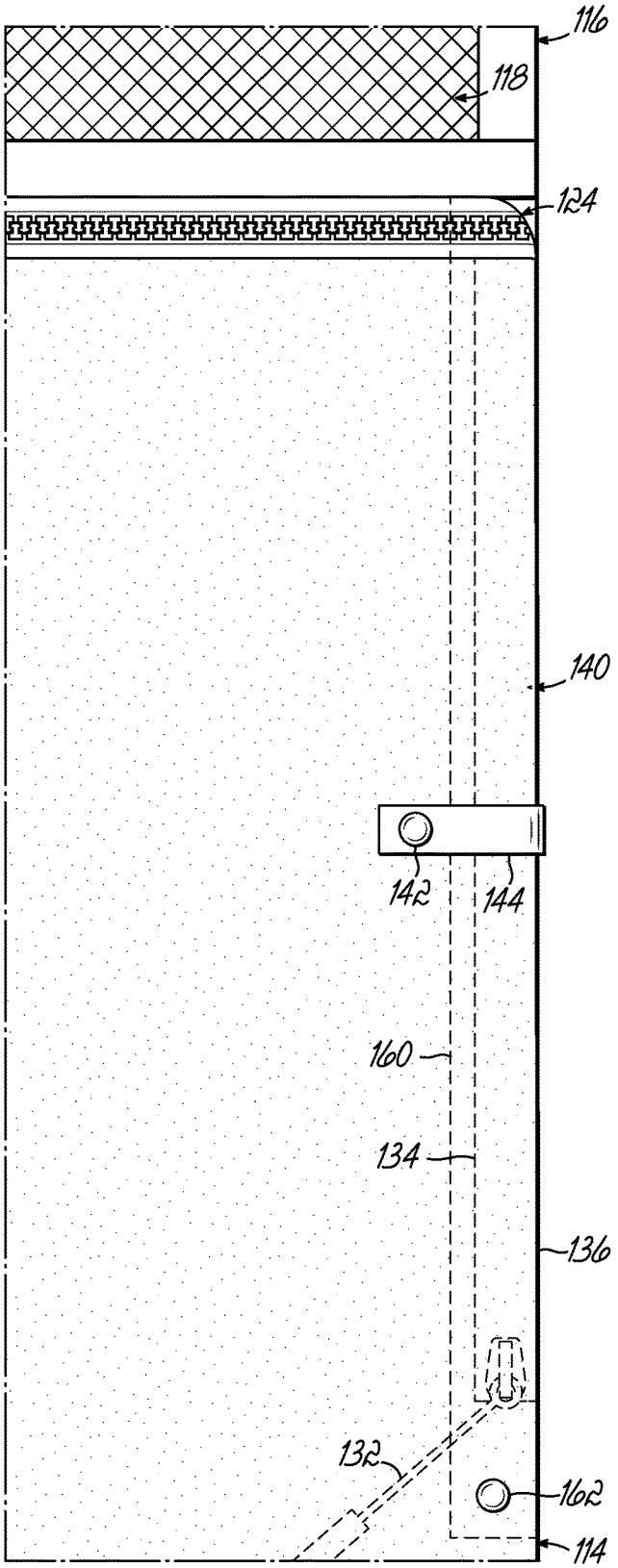

When the top and bottom portions 116, 114 are mated together as shown in FIG. 7, the zipper extension 134 may be tucked into a pocket 140 formed in the bottom portion 114 of the curtain 110 (see FIGS. 12-12D). The pocket 140 conceals the zipper extension 134 and inhibits inadvertent pulling on the zipper extension 134 when not being used to zip/unzip the zipper mechanism 124. The pocket 134 may be formed at the side edge 136 of the bottom portion 114 and include a panel of fabric sewn or otherwise attached to the bottom portion 114. One or more snaps 142 may be used to secure a strip 144 of material and capture the extension 134 in the pocket 140.

FIG. 7 is a perspective view of this embodiment of this invention fully assembled. Shown is the curtain 110 of this embodiment comprising the bottom portion 114 and the ventilated top portion 116. A number of different materials may be used for the bottom portion 114. Various antimicrobial materials may be topically applied periodically or they may be impregnated within the curtain material during the manufacturing process. This provides an impediment to germs in the environment surrounding the bed 128 or examination area 130 by denying a surface where the organisms can multiply. The zipper mechanism 124 (discussed further elsewhere herein) extends fully from beyond from the left perimeter edge of the hospital curtain 110 to beyond the right perimeter edge of the hospital curtain 110 in various embodiments. The zipper mechanism 124 has upper and lower zipper tracks 124*a*, 124*b* with matingly interlocking teeth 126 that are separable for removing the bottom portion 114 from the top portion 116 when the matingly interlocking teeth 126 are disengaged from one another.

The zipper mechanism 124 may be zipped or unzipped by a user manually grasping a pull tab 132 on the zipper mechanism 124 and pulling it along the length of the zipper tracks 124*a*, 124*b* as shown in FIG. 11A. Another feature of various embodiments of this invention shown in FIG. 11B is a zipper assist pole 46 having an elongate shaft 148 and a head 150 at one end of the shaft 148. The shaft 148 may be telescopic in some embodiments. The head 150 may be Y-shaped with a pair of arms 52 each terminating at a distal end thereof in a rounded boss 154. A juncture 156 of the arms 52 at the root of the Y-shaped head 150 may include a socket or other catch to engage the pull tab 132 of the zipper mechanism 124. With the zipper assist pole 46, a user may grasp the zipper extension 134 and begin the zipping process. The user may engage the pull tab 132 into the socket 156 on the head 150 and grasp the shaft 148 of the zipper assist pole 46 to thereby move the pull tab 132 along the zipper tracks 124*a*, 124*b* at an elevated position over their head proximate the lower edge of the top portion 116. The pole 46 may be used to pull the pull tab 132 along the zipper tracks 124*a*, 124*b* while the user is standing on the floor 138 even though the juncture between the portions 114, 116 is well above the user's height or reach. The zipper assist pole 46 may be used to zip or unzip the zipper mechanism 124. When not in use, the zipper assist pole 46 may be hung on a conveniently located wall mount.

Another feature of various embodiments of this invention is shown in FIGS. 8-11 as one or more straps 160 extending downwardly from the top portion 116 at spaced intervals along the width of the curtain 110. Each strap 160 may have a fastener 162 at the distal end of the strap 160 or one or more fasteners 162 along the length of the strap 160 to initially and releasably attach the bottom portion 114 to the top portion 116 via the straps 160. When installing a clean bottom portion 114 onto the top portion 116, a user may not be able to both hold the bottom portion 114 and begin the process of engaging the zipper mechanism 124 while keeping the clean bottom portion 114 from touching the floor 138 and being soiled. To avoid this situation, the user may initially mate, engage or fasten complimentary fasteners 62 on the straps 160 and on the folded bottom portion 114 as shown in FIG. 8. As such, the bottom portion 114 will be suspended by the straps 160 as the user begins the process of engaging the zipper mechanism 124 for further attachment of the bottom portion 114 to the top portion 116.

FIG. 14 shows the bottom portion 114 starting to be separated from the top portion 116 for replacement or cleaning. The hospital curtain 110 of this invention includes the zipper mechanism 124 which may be a quick release zipper mechanism in some embodiments. The zipper mechanism 124 provides an engagement means that allows a user to remove the bottom portion 114 from the top portion 116 when desired, as will be discussed below. In one embodiment, the interlocking teeth 126, are made of a polymer substance and may also be impregnated or infused with an antimicrobial compound similar to some embodiments of the bottom portion 114 of the hospital curtain 110. The zipper mechanism 124 may be separated by a user pulling the handle or zipper pull tab 132 of the zipper mechanism 124 in the direction of arrow 1A in FIG. 14. Note also that it is contemplated that in the case of an emergency, if the curtain 110 needed to be removed more quickly, the interlocking zipper teeth 126, could be disengaged from one another by simply pulling downwardly as indicated at directional arrow 1A in the FIG. 14, which would also cause the zipper tracks 124*a*, 124*b* to detach from one another.

FIG. 14 is an enlarged partial front view of the top portion 116 with the bottom portion 114 broken away. The zipper mechanism 124 is shown with the upper zipper track 124*a*.

FIGS. 16-17B show a further feature of various embodiments of this invention. In many hospital or other settings, one or more curtains 110 may need to be serially attached to each other at the side edges 136 of the respective curtains 110. A side edge seam 164 may be temporarily formed by mating side edge seam strips 166 together as shown in FIG. 16. The side edge seam strip 166 may be located on the side edge 136 of each top portion 116 and each bottom portion 114 and include a seam mechanism 168 such as mating snaps, hook and loop fastener or other mechanism to temporarily join the side edges 136 of the curtains 110 together. The curtains 110 joined together by the side edge seam strips 166 may be suspended from a common track 112 for convenient movement of the joined curtains 110 along the track 112 and enhanced privacy offered by the adjacent curtains 110. The curtains 110 can be easily separated along the side edge seam strips 166 for replacement and/or cleaning of the bottom portions 114.

Shown in FIG. 11 is a detailed view of the hospital curtain 110 of this invention with the bottom portion 114 removed. The zipper mechanism 124 extends from beyond the left side edge of the hospital curtain 110 to beyond the side edge 136 of the hospital curtain 110. The zipper mechanism 124 has the upper and lower zipper tracks 124*a*, 124*b* with the matingly interlocking teeth 126 that are separable for removing the bottom portion 114 from the top portion 116 when the matingly interlocking teeth 126 are disengaged.

FIG. 15 is an enlarged perspective view of the clinical setting 130 similar to FIG. 1, showing the zipper mechanism 124 opened and the bottom portion 114 removed away from the top portion 116. The zipper mechanism 124 has the upper and lower zipper tracks (124*a* and 124*b*, respectively) with matingly interlocking teeth 126 that are separable for removing the bottom portion 114 from the top portion 116 when the matingly interlocking teeth 126 are disengaged as shown. As mentioned above, the user may either use the zipper handle 132, the zipper assist pole 146, or may, in case of urgency, simply pull the engaged teeth 126 apart as shown in FIG. 14.

Details of CCN-107B Follow

FIG. 18 is a perspective view of one embodiment of this invention being a curtain assembly 210 suspended from a track 212, showing a wide bottom portion 214 separable from a narrow top portion 216. The track 212 may be mounted to a ceiling atop an exam area 230 defined at least in part by the curtain assembly 210. The top portion 216 may have a top segment made of a mesh material 218 for ventilation and is slideably attached along the ceiling track 212 using a number of curtain carriers coupled to spaced apart eyelets 220 on a top edge 222 of the top portion 216. An attachment mechanism which in some embodiments is a zipper mechanism 224 extends longitudinally between and selectively joins a top edge 225 of the bottom portion 214 to a bottom edge 227 of the top portion 216 of the hospital curtain 210. Other attachment mechanisms may be used within the scope of this invention. The zipper mechanism 224 has upper and lower zipper tracks 224*a*, 224*b* with matingly interlocking teeth 226 that are separable for selectively removing/attaching the bottom portion 214 from/to the top portion 216 of the hospital curtain 210 when desired.

FIG. 18 is a perspective view of this invention fully assembled. Shown is the curtain 210 of this invention comprising the bottom portion 214 and the ventilated top portion 216. A number of different materials may be used for the bottom portion 214. Various antimicrobial materials may be topically applied periodically or they may be impregnated within the curtain material during the manufacturing process. This provides an impediment to germs in the environment surrounding the bed 236 or examination area 230 by denying a surface where the organisms can multiply. The zipper mechanism 224 (discussed further elsewhere herein) extends fully from the left side edge of the hospital curtain 210 to the right side edge of the hospital curtain 210 in various embodiments. The zipper mechanism 224 has upper and lower zipper tracks 224*a*, 224*b* with matingly interlocking teeth 226 that are separable for removing the bottom portion 214 from the top portion 216 when the matingly interlocking teeth 226 are disengaged from one another.

A joint 228 between the top and bottom portions 214, 216 in various embodiments of this invention has a middle section 229 which extends generally parallel to the plane of the ceiling and lateral generally vertical sections 231 each joined to the middle section 229 by an arcuate section 233. The zipper mechanism 224 follows the path of the joint 228 between the various sections 229, 231, 233 of the top and bottom portions 214, 216. In the embodiment of the top portion 214 show in FIG. 18, the mesh 218 extends downwardly at the lateral ends of the curtain assembly 210. In the embodiment of the curtain assembly 210 shown in FIG. 22, an intermediate portion 235 extends adjacent to the middle section 229 proximate to the bottom edge 227 of the top portion 216 and includes generally triangular shaped lateral end sections 237 adjacent to the joint 228. The intermediate and triangular portions 235, 237 may be opaque, non-mesh or another material according to this invention.

According to various embodiments of this invention, the zipper mechanism 224 may include a slider hub 238 and a zipper pull tab 232 as seen in FIG. 19A. The zipper pull tab 232 may be secured to the slider hub 238 by a bridge 240. The slider hub 238 may be pulled along the zipper tracks 224*a*, 224*b* by a user engaging and pulling the zipper pull tab 232. The user may be standing on the floor 239 to reach the zipper mechanism 224 via a zipper assist pole 234 to zip or unzip the zipper mechanism 224.

The zipper mechanism 224 may be zipped or unzipped by a user manually grasping the zipper pull tab 232 on the zipper mechanism 224 and pulling it along the length of the zipper tracks 224*a*, 224*b*. Another feature of various embodiments of this invention shown in FIGS. 19-20A is the zipper assist pole 234 having an elongate shaft 248 and a head 250 at one end of the shaft 248. The shaft 248 may be telescopic in some embodiments. The head 250 may be of any configuration to engage the zipper hub 238 and/or zipper pull tab 232. In one embodiment, the head 250 includes a stem 252 with a ring 254 coupled to a distal end and a hook 256 coupled to the ring 254 as shown in FIG. 19A. This arrangement allows the hook 256 to engage an aperture 232*a* in the zipper pull tab 232 and the user may pull the zipper hub 238 along the zipper tracks 224*a*, 224*b* to engage or disengage the zipper mechanism 224. The hook 256 may articulate as needed about the ring 254 and head 250 to allow for smooth and easy zipping and unzipping of the zipper mechanism 224.

With the zipper assist pole 234, a user may grasp the two tracks 224*a*, 224*b* of the zipper mechanism 224 and begin the zipping process. The user may engage the pull tab 232 with the hook 256 on the head 250 and grasp the shaft 248 of the zipper assist pole 234 to thereby move the pull tab 232 along the zipper tracks 224*a*, 224*b* at an elevated position over their head proximate the lower edge 227 of the top portion 216. The pole 234 may be used to pull the pull tab 232 along the zipper tracks 224*a*, 224*b* while the user is standing on the floor 239 even though the joint 228 between the portions 214, 216 is well above the user's height or reach without the pole 234. The zipper assist pole 234 may be used to zip or unzip the zipper mechanism 224. When not in use, the zipper assist pole 234 may be hung on a conveniently located wall mount.

FIG. 19 shows the bottom portion 214 starting to be joined to the top portion 216. The hospital curtain 210 of this invention includes the zipper mechanism 224 which may be a quick release zipper mechanism in some embodiments. The zipper mechanism 224 provides an engagement means that allows a user to attach or remove the bottom portion 214 to or from the top portion 216 when desired. In one embodiment, the interlocking teeth 226, are made of a polymer substance and may also be impregnated or infused with an antimicrobial compound similar to the bottom portion 214 of the hospital curtain 210. The zipper mechanism 224 may be separated by a user pulling the pole 345 or zipper pull tab 232 of the zipper mechanism 224 in the direction of arrow 2A in FIG. 19. Note also that it is contemplated that in the case of an emergency, if the curtain 210 needed to be removed more quickly, the interlocking zipper teeth 226, could be disengaged from one another by simply pulling downwardly, which would also cause the zipper tracks 224*a*, 224*b* to detach from one another.

This invention provides a privacy curtain 210 for hospital room or examination area 230 use. With the rise of infections contracted in hospitals, some of these being partially or substantially resistant to antibiotic treatment, this invention addresses a real need by denying any airborne organisms or germs unknowingly carried by a person in the environment a surface proximate the patient where the pathogens can rest or multiply. As mentioned above, the bottom portion 214 of the curtain 210 may be contaminated and this invention allows for more frequent cleaning and/or replacement. It is contemplated that the bottom portion 214 of the invention would be easily washable and able to undergo sterilization procedures (high temperatures, chemical treatment, or the like) in case of being removed.

These foregoing embodiments of the invention are exemplary only and in no manner should be viewed as exhaustive or limiting on the scope of this invention. Alternative numbers of components, method steps, materials, parameters, arrangements and other aspects may be utilized within the scope of this invention.

From the above disclosure of the general principles of this invention and the preceding detailed description of at least one embodiment, those skilled in the art will readily comprehend the various modifications to which this invention is susceptible. Therefore, we desire to be limited only by the scope of the following claims and equivalents thereof.

We claim:

1. A curtain system comprising:

a curtain extending from a first side edge to a second side edge and comprising:

a curtain top portion comprising:

a top edge configured for coupling with a track disposed above the curtain;

a first strap, wherein the first strap is located at the first side edge of the curtain, and wherein the first strap comprises a first fastener;

a second strap, wherein the second strap is located at the second side edge of the curtain, and wherein the second strap comprises a second fastener;

a curtain bottom portion comprising:

a first complementary fastener located at the first side edge of the curtain;

a second complementary fastener located at the second side edge of the curtain; and a bottom edge; and a zipper comprising:

an upper tape portion coupled with the curtain top portion;

a lower tape portion coupled with the curtain bottom portion; and a slider configured to selectively initially join, completely join, and separate the upper tape portion to and from the lower tape portion; wherein the first fastener and the first complementary fastener together comprise a first pair of snaps configured to selectively couple with and decouple from one another;

the second fastener and the second complementary fastener together comprise a second pair of snaps configured to selectively couple with and decouple from one another;

the curtain top portion is configured to suspend from above in a vertical orientation such that:

the first side edge and the second side edge are spaced laterally from one another;

at least a portion of the first strap extends such that the first fastener is disposed below an adjacent portion of the upper tape portion of the zipper; and at least a portion of the second strap extends such that the second fastener is disposed below an adjacent portion of the upper tape portion of the zipper;

the first complementary fastener of the curtain bottom portion is configured to selectively couple to the first fastener of the first strap prior to the slider initially joining the upper tape portion and the lower tape portion together;

the second complementary fastener of the curtain bottom portion is configured to selectively couple to the second fastener of the second strap prior to the slider initially joining the upper tape portion and the lower tape portion;

the first strap and the second strap are configured to, in response to coupling of the first complementary fastener with the first fastener and coupling of the second complementary fastener with the second fastener, suspend the entirety of the curtain bottom portion from the first strap and the second strap prior to the slider initially joining the upper tape portion and the lower taper portion;

during suspension of the entirety of the curtain bottom portion from the first strap and the second strap, the slider is configured to initially join the upper tape portion and the lower tape portion, while the first complementary fastener remains coupled with the first fastener and the second complementary fastener remains coupled with the second fastener; and following initial joining of the upper tape portion and the lower tape portion by the slider, the slider is configured to completely join the upper tape portion and the lower tape portion, while the first complementary fastener remains coupled with the first fastener and the second complementary fastener remains coupled with the second fastener.

2. The curtain system of claim 1 wherein the zipper further comprises:

a central zipper portion extending between the first side edge and the second side edge;

a first zipper extension extending outwardly of the first side edge and downwardly from the curtain top portion; and a second zipper extension extending outwardly of the second side edge and downwardly from the curtain top portion.

3. The curtain system of claim 2 wherein:

the first zipper extension comprises a first terminus of the zipper;

the second zipper extension comprises a second terminus of the zipper;

the curtain further comprises a first pocket adjacent to the first side edge;

the curtain further comprises a second pocket adjacent to the second side edge;

the first pocket is configured to selectively receive and retain the first terminus of the zipper; and the second pocket is configured to selectively receive and retain the second terminus of the zipper.

* * * * *